US011739997B2

(12) United States Patent
Abdoli et al.

(10) Patent No.: US 11,739,997 B2
(45) Date of Patent: Aug. 29, 2023

(54) COMPRESSOR-ASSISTED THERMAL ENERGY MANAGEMENT SYSTEM

(71) Applicant: Rocky Research, Boulder City, NV (US)

(72) Inventors: Abas Abdoli, Henderson, NV (US); Kaveh Khalili, Boulder City, NV (US); Uwe Rockenfeller, Boulder City, NV (US)

(73) Assignee: Rocky Research, Boulder City, NV (US)

( * ) Notice: Subject to any disclaimer, the term of this patent is extended or adjusted under 35 U.S.C. 154(b) by 517 days.

(21) Appl. No.: 16/576,566

(22) Filed: Sep. 19, 2019

(65) Prior Publication Data

US 2021/0088266 A1 Mar. 25, 2021

(51) Int. Cl.

| | |
|---|---|
| ***F25B 15/10*** | (2006.01) |
| ***F25B 49/02*** | (2006.01) |
| ***F25B 17/08*** | (2006.01) |
| ***F25B 15/16*** | (2006.01) |
| ***F25B 49/04*** | (2006.01) |

(52) U.S. Cl.

CPC ..... *F25B 49/022* (2013.01); *F25B 15/10* (2013.01); *F25B 15/16* (2013.01); *F25B 17/08* (2013.01); *F25B 49/027* (2013.01); *F25B 49/04* (2013.01)

(58) Field of Classification Search

CPC ..... F25B 15/10; F25B 15/16; F25B 17/08; F25B 49/022; F25B 49/027; F25B 49/04

See application file for complete search history.

(56) References Cited

U.S. PATENT DOCUMENTS

| | | | |
|---|---|---|---|
| 4,848,994 | A | 7/1989 | Rockenfeller |
| 4,875,914 | A | 10/1989 | Wireman |
| 5,298,231 | A | 3/1994 | Rockenfeller |
| 5,384,101 | A | 1/1995 | Rockenfeller |
| 5,441,716 | A | 8/1995 | Rockenfeller |
| 5,463,879 | A | 11/1995 | Jones |
| 5,477,706 | A | 12/1995 | Kirol et al. |
| 5,598,721 | A | 2/1997 | Rockenfeller et al. |
| 6,224,842 | B1 | 5/2001 | Rockenfeller et al. |
| 6,282,919 | B1 | 9/2001 | Rockenfeller et al. |

(Continued)

FOREIGN PATENT DOCUMENTS

| | | | |
|---|---|---|---|
| WO | WO 2010/129801 | 11/2010 | |
| WO | WO-2010129801 A1 * | 11/2010 | ..... B60H 1/00 |

OTHER PUBLICATIONS

International Search Report for International Application No. PCT/US2020/046813 dated Oct. 30, 2020.

(Continued)

*Primary Examiner* — Nael N Babaa

(74) *Attorney, Agent, or Firm* — Shumaker & Sieffert, P.A.

(57) ABSTRACT

Systems and methods for compressor-assisted sorption rate. A sorption system includes a sorber that absorbs and desorbs a refrigerant gas, such as ammonia, onto and from a coordinative complex compound. The system includes an evaporator, a condenser, and a compressor. The temperature and pressure of the gas within the sorber are monitored and the compressor is controlled to adjust the pressure to increase the absorption and desorption rates and increase the thermal cycle speed of the sorption system for applications such as laser systems requiring rapid, periodic cooling.

32 Claims, 11 Drawing Sheets

(56) References Cited

U.S. PATENT DOCUMENTS

| | | | | |
|---|---|---|---|---|
| 6,415,625 | B1 | 7/2002 | Rockenfeller et al. | |
| 6,477,856 | B1 | 11/2002 | Khalili et al. | |
| 6,736,194 | B2 | 5/2004 | Rockenfeller et al. | |
| 9,822,999 | B2 | 11/2017 | Rockenfeller et al. | |
| 2010/0212493 | A1 | 8/2010 | Rasmussen et al. | |
| 2017/0211891 | A1* | 7/2017 | Collins | C01B 3/0026 |
| 2018/0252447 | A1 | 9/2018 | Rockenfeller et al. | |
| 2018/0252453 | A1* | 9/2018 | Rockenfeller | F25B 15/06 |

OTHER PUBLICATIONS

Rockenfeller. Development of Dual Temperature Ammines for Heat Pump Latent Heat Storage Application. Final Report. Published Mar. 1986. Oak Ridge National Laboratory. Martin Marietta. ORNL/Sub/84-47999/1.

International Preliminary Report on Patentability from International Application No. PCT/US2020/046813, dated Mar. 15, 2022, 7 pp.

* cited by examiner

COMPRESSOR-ASSISTED THERMAL ENERGY MANAGEMENT SYSTEM

BACKGROUND

Field

This disclosure relates generally to sorption systems using sorbers with complex compounds and a sorber gas. In particular, features are described for systems and methods for compressor-assisted sorption for cycle speed enhancement and other advantages.

Description of the Related Art

Absorption/desorption processes or reactions are between polar gases and certain metal salts to yield coordinative complex compounds. These complex compounds are the basis for efficient refrigeration, thermal storage, heat pump systems and power systems having high energy density. The reaction rates between the gas and the complex compound affect the time it takes to absorb and desorb a given amount of the gas into or from the complex compound. The rate at which such thermal energy can be transferred is dependent on the sorption rates of the systems.

Coordinative complex compounds used within such a system may include polar refrigerants with adequate dipole moment to entertain the refrigerant bond in a solid lattice structure. The surface sorption compounds may be comprised of silica gel, zeolites, and activated carbon that can act to absorb non-polar refrigerants. Coordinative complex compounds are capable of holding much more refrigerant mass content and their thermodynamic mono-variance allows the sorption process to proceed at constant temperature and pressure throughout wide concentration ranges defined by the complex compound coordination spheres, as described for example in U.S. Pat. No. 4,848,994, titled "SYSTEM FOR LOW TEMPERATURE REFRIGERATION AND CHILL STORAGE USING AMMONIATED COMPLEX COMPOUNDS" and issued Jul. 18, 1989, and in U.S. Pat. No. 4,875,914, titled "GAS AND ODOR ADSORBING UNIT" and issued Oct. 24, 1989, the entire disclosure of each of which is incorporated by reference herein. In addition, the rate at which such thermal energy can be transferred is dependent on the sorption rates of the systems. Systems directed to improving sorption rates are described, for example, in U.S. Pat. No. 5,298,231, titled "METHOD FOR ACHIEVING HIGH REACTION RATES IN SOLID-GAS REACTOR SYSTEMS" and issued Mar. 29, 1994, in U.S. Pat. No. 5,384,101, titled "METHOD AND APPARATUS FOR ACHIEVING HIGH REACTION RATES IN SOLID-GAS REACTOR SYSTEMS" and issued Jan. 24, 1995, in U.S. Pat. No. 5,441,716, titled "METHOD AND APPARATUS FOR ACHIEVING HIGH REACTION RATES" and issued Aug. 15, 1995, in U.S. Pat. No. 6,224,842, titled "HEAT AND MASS TRANSFER APPARATUS AND METHOD FOR SOLID-VAPOR SORPTION SYSTEMS" and issued May 1, 2001, in U.S. Pat. No. 6,736,194, titled "HEAT AND MASS TRANSFER APPARATUS AND METHOD FOR SOLID-VAPOR SORPTION SYSTEMS" and issued May 18, 2004, in U.S. Pat. No. 9,822,999, titled "SYSTEMS, DEVICES AND METHODS FOR GAS DISTRIBUTION IN A SORBER" and issued Nov. 21, 2017, in U.S. Patent Publication No. 2018/0252447, titled "BURST MODE COOLING SYSTEM" and published Sep. 6, 2018, and in U.S. Patent Publication No. 2018/0252453, titled "INTELLIGENT COOLING SYSTEM" and published Sep. 6, 2018, the entire disclosures of each of which is incorporated by reference herein.

Some thermal loads can generate a burst of heat that needs to be dissipated to avoid overheating the object or process linked to the thermal load. For example, a directed energy weapons system, such as a high energy laser, when activated generates a high amount of energy during relatively short lasing times.

SUMMARY

The embodiments disclosed herein each has several aspects no single one of which is solely responsible for the disclosure's desirable attributes. Without limiting the scope of this disclosure, its more prominent features will now be briefly discussed. After considering this discussion, and particularly after reading the section entitled "Detailed Description of Certain Embodiments," one will understand how the features of the embodiments described herein provide advantages over existing systems, devices and methods for sorption systems.

In one aspect, a thermal sorption system is described. The system comprises a sorber, a heat source, an evaporator, a condenser, a compressor, and a control system. The sorber comprises solid complex compounds. The heat source is in thermal communication with the solid complex compounds. The evaporator is in thermal communication a thermal load. The condenser is in fluid communication with the sorber and the evaporator. The compressor is in fluid communication with the sorber, the evaporator, and the condenser, and is configured to adjust a pressure of a sorber gas. The control system is configured to operate the compressor and heat source to control a rate of absorption of the gas onto, and a rate of desorption of the gas from, the solid complex compound.

Various embodiments of the various aspects may be implemented. The control system may be further configured to operate the compressor to adjust the pressure of the gas between i) the evaporator and the sorber, ii) between the condenser and the sorber, or iii) both between the evaporator and the sorber and between the condenser and the sorber. The control system may be further configured to operate the compressor to increase a differential pressure of the sorber to accelerate the rates of absorption and desorption of the gas. The control system may be further configured to operate the compressor to decrease the pressure of the gas in the sorber during desorption to reduce a desorbing temperature required for desorption at a desired desorption rate. The control system may be further configured to operate the compressor to enhance the rate of absorption by increasing the pressure of the sorber gas between about 0.5 bar and 15 bar above an existing pressure. The control system may be further configured to operate the compressor to enhance the rate of desorption by increasing the pressure of the sorber gas between about 1 bar and 25 bar above an existing pressure. The gas may be ammonia.

The compressor may be an oil-free compressor. The compressor may be integrated with a lubricant management system. The compressor may be electrically, hydraulically or pneumatically driven. The compressor may comprise a compressor section and an expander section. The solid complex compound may be an ammoniated complex compound having an absorbent comprising an alkali halide, an alkali-earth halide, or a transition metal halide. The absorbent may comprise $SrCl_2$, $CaCl_2$, $MnCl_2$, $MgCl_2$, LiCl, or $CoCl_2$.

The controller may be further configured to operate the compressor based on control parameters comprising i) a desired temperature of the thermal load, ii) a desired capacity of the sorption system, or iii) operating conditions including ambient temperature, humidity, and/or altitude. The control parameters may be based on a required cooling of the thermal load and an ambient temperature. The thermal load may comprise a laser system.

The thermal sorption system may further comprise a second sorber and a second thermal system. The second sorber may be configured to absorb the sorber gas onto, and desorb the sorber gas from, a solid complex compound of the second sorber, where the second sorber is in fluid communication with the evaporator, the condenser and the compressor. The thermal system may be in thermal communication with the second sorber and configured to adjust a temperature of the second sorber. The control system may be in electronic communication with the second thermal system and be further configured to operate the compressor, the thermal system, and the second thermal system cooperatively to control a rate of absorption of the gas onto, and a rate of desorption of the gas from, the solid complex compounds of the first and second sorbers.

The thermal sorption system may further comprise a second compressor, a second sorber and a second thermal system. The second compressor may be in fluid communication with the evaporator and the condenser. The second sorber may be configured to absorb the gas onto, and desorb the gas from, a solid complex compound of the second sorber, where the second sorber is in fluid communication with the evaporator, the condenser and the second compressor. The second thermal system may be in thermal communication with the second sorber and configured to adjust a temperature of the second sorber. The control system may be in electronic communication with the second thermal system and be further configured to operate the second compressor and the second thermal system cooperatively to control a rate of absorption of the gas onto, and a rate of desorption of the gas from, the solid complex compound of the second sorber.

In another aspect, a thermal sorption system is described. The system comprises a plurality of sorbers, an evaporator, a condenser, one or more compressors, a plurality of thermal systems, and a control system. The plurality of sorbers each has a respective solid complex compound and is configured to absorb a gas onto, and desorb the gas from, the respective solid complex compound. The evaporator is in fluid communication with the plurality of sorbers and is configured to be in thermal communication with a thermal load. The condenser is in fluid communication with the plurality of sorbers and the evaporator. The one or more compressors is/are in fluid communication with the evaporator, the condenser, and one or more respective sorbers of the plurality of sorbers, where the one or more compressors is each configured to adjust a pressure of the gas in one or more respective sorbers. The plurality of thermal systems is each in thermal communication with a respective sorber of the plurality of sorbers and each is configured to adjust a temperature of the respective sorber. The control system is in electronic communication with the one or more compressors and the plurality of thermal systems and is configured to operate the one or more compressors and the plurality of thermal systems cooperatively to control a rate of absorption of the gas onto, and a rate of desorption of the gas from, the solid complex compounds of the first and second sorbers.

Various embodiments of the various aspects may be implemented. The control system may be further configured to operate the one or more compressors to adjust the pressure of the gas between i) the evaporator and the plurality of sorbers, ii) between the condenser and the plurality of sorbers, or iii) both between the evaporator and the plurality of sorbers and between the condenser and the plurality of sorbers. The control system may be further configured to operate the one or more compressors to increase a respective differential pressure of the respective sorber to accelerate the rates of absorption and desorption of the gas. The control system may be further configured to operate the one or more compressors to increase the pressure of the gas in the plurality of sorbers during desorption to reduce a desorbing temperature required for desorption at a desired desorption rate. The control system may be further configured to operate the one or more compressors to enhance the rate of absorption by increasing the pressure of the gas between about 0.5 bar and 15 bar above an existing pressure. The control system may be further configured to operate the one or more compressors to enhance the rate of desorption by increasing the pressure of the gas between about 1 bar to 25 bar above an existing pressure. The respective solid complex compound may comprise an ammoniated complex compound having an absorbent comprising an alkali halide, an alkali-earth halide, or a transition metal halide. The absorbent may comprise $SrCl_2$, $CaCl_2$, $MnCl_2$, $MgCl_2$, LiCl, or $CoCl_2$. The thermal load may comprise a laser system.

In another aspect, a method of providing thermal conditioning of a thermal load using a sorber is described. The method comprises detecting a temperature of a thermal load; detecting a pressure and temperature within the sorber; and cooperatively controlling a compressor and a heating/cooling source communicating with the sorber to adjust the pressure and temperature within the sorber.

The method may further comprise controlling the compressor to adjust a pressure of a gas between i) an evaporator and the sorber, ii) between a condenser and the sorber, or iii) both between the evaporator and the sorber and between the condenser and the sorber. The method may further comprise controlling the compressor to increase a differential pressure of the sorber to accelerate rates of absorption and desorption of a gas in the sorber. The method may further comprise controlling the compressor to increase the pressure of a gas in the sorber during desorption to reduce a desorbing temperature required for desorption at a desired desorption rate. In some embodiments, thermal load may comprise a laser system.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several embodiments in accordance with the disclosure and are not to be considered limiting of its scope, the disclosure will be described with additional specificity and detail through the use of the accompanying drawings. In the following detailed description, reference is made to the accompanying drawings, which form a part hereof. In the drawings, similar symbols typically identify similar components, unless context dictates otherwise. It will be readily understood that the aspects of the present disclosure, as generally described herein, and illustrated in the figures, can be arranged, substituted, combined, and designed in a wide variety of different configurations, all of which are explicitly contemplated and make part of this disclosure.

DETAILED DESCRIPTION

Figure 1B:
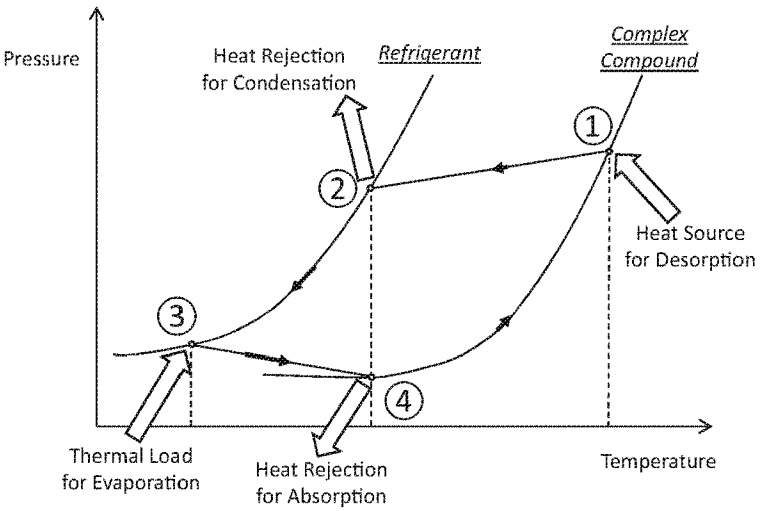
FIG. 1B is a pressure-temperature data plot showing an embodiment of a thermal cycle corresponding to use of the sorption system of FIG. 1A.

The following description and examples illustrate certain embodiments of the present invention in detail. Those of skill in the art will recognize that there are numerous variations and modifications of this invention that are encompassed by its scope. Accordingly, the description of certain embodiments should not be deemed to limit the scope of the present invention.

Systems and methods are disclosed for cooling thermal loads using a compressor-assisted sorption system. Such systems use a sorber gas that absorbs onto and desorbs from a sorbent bed of solid complex compounds during a heating or cooling cycle. In one embodiment, the system includes a compressor that is used to adjust the rate or amount of sorber gas that absorbs onto the sorbent bed of the complex compound material. For example, the system may include a relatively small or light weight compressor connected to the sorber line that carries sorber gas to the sorbent bed. An electronic controller may be connected to the compressor and programmed to adjust the speed of the compressor to control the amount of pressure placed onto the sorber gas as it approaches the sorbent bed. By using the compressor to increase the pressure of the sorber gas as it approaches the sorbent bed, the rate of absorption of the gas onto the sorbent will increase above and beyond the rate of absorption of similar sized systems that do not include the compressor. In contrast, reducing the pressure placed on the sorber gas will result in the rate of absorption of the gas onto the sorbent bed being reduced. This allows the electronic controller to be programmed to intelligently adjust the rate of sorber gas absorption onto the sorbent bed and thereby adjust the amount of cooling or heating being managed by the system.

Similarly, the compressor may also be connected to the sorber gas line leading away from the sorbent bed. When the compressor is activated it creates a low pressure at the sorbent bed which allows the system to remove sorber gas from the sorbent bed faster than a similar system that does not have a compressor creating a low pressure.

By having a controller with stored instructions configured to intelligently control one or more compressors with the sorber system, a system can provide more cooling capacity than similar systems without the compressor.

In one embodiment, the controller also manages the amount of heat being generated to drive the sorber gas from the sorbent bed. Increasing the heat, while simultaneously increasing the speed of a compressor that is drawing the sorber gas from the sorbent bed can decrease the system's cycle time and thereby increase the capacity of the system to cool a thermal load.

In one embodiment, the compressor-assisted system may be triggered to operate by the thermal load. For example, a controller in the system may be connected to a thermal detection system that detects the temperature of the thermal load. Once the thermal load reaches a predetermined temperature, the compressor assisted system is activated to rapidly cool the thermal load. The cooling cycle may be for a predetermined time or be activated until the thermal load reaches a target lower temperature.

In another embodiment, the controller for the compressor-assisted system may be connected to a circuit that is used to activate the thermal load. For example, if the thermal load includes a laser that rapidly heats when activated, the controller may be programmed to detect the activation of the laser, and then begin a rapid cooling cycle even though the temperature of the thermal load (laser) has not yet reached a target temperature. This allows the compressor-assisted system to begin its cooling cycle and start rapidly cooling the thermal load in advance of the thermal load undergoing a rapid heating cycle.

Solid-gas sorption systems as described herein may include a variety of sorbents. For example, sorbents including zeolite, activated carbon, silica gel and coordinative complex compound systems, can be operated as cooling systems, heating systems, thermal energy storage systems, or combinations thereof. Coordinative complex compounds used within these systems can include polar refrigerants with adequate dipole moment to entertain the refrigerant bond in a solid lattice structure. The surface sorption compounds may be comprised of silica gel, zeolites, and activated carbon that can act to absorb non-polar refrigerants.

Energy efficiency is commonly an important characteristic in the use of thermally activated sorption systems. Certain applications, however, are more sensitive to total system size and weight than to energy efficiency. For these applications, the size and weight of the apparatus are the primary criteria, as available volume and weight on a given platform that contains the system may be limited. For example, a system may need to have a predetermined total cooling capacity, but not have a weight or footprint larger than a predetermined size. Such applications include, for example, burst cooling requirements, during which a vast amount of thermal energy is required for a short period of time. The cooling may be needed repeatedly after pauses between cooling periods. This may be required to quickly cool down an object repeatedly over an extended period of time. The cooling may be tuned to cool an object or process that generates a burst of heat that needs to be dissipated to avoid overheating of the thermal load.

One example of a system that generates a burst of heat is a directed energy system, such as a high energy laser system. When activated, these systems generate a relatively high amount of energy for relatively short periods of time, as the laser is activated. High energy lasers may range from 5 kilowatts (kW) to 500 kW and up to one to two Megawatts of power or more. Typical efficiencies for such devices may range from 20% to almost 50%, with a current average efficiency of around 30%. Thus, for a 50 kW laser output, roughly 117 kW of heat may need to be removed from the active laser components. These components can include the laser diodes, which are used to generate the photons during a laser pulse. Such lasing periods typically last one second to a few seconds, although periods of 5, 10, 15, 20, 25, 30, 40, 50 seconds or even a few minutes are possible. In either case the thermal energy should be removed from the laser diodes to avoid overheating or shutdown of the laser as it's being used. The present compressor-assisted system may be configured to immediately cool over a very short duration and then rapidly be prepared for another cooling burst cycle to prepare for an additional lasing period.

Improving the readiness of such systems can be enhanced by constructing the system out of a multitude of sorbers in which some of the sorbers may discharge, while other sorbers are charging, and yet other sorbers are undergoing the temperature change. Details of examples of features for sorption systems that may be used in such operation are described, for example, in U.S. Pat. No. 5,598,721, titled "HEATING AND AIR CONDITIONING SYSTEMS INCORPORATING SOLID-VAPOR SORPTION REACTORS CAPABLE OF HIGH REACTION RATES" and issued Feb. 4, 1997, in U.S. Pat. No. 6,282,919, titled "AUXILIARY ACTIVE MOTOR VEHICLE HEATING AND AIR CONDITIONING SYSTEM" and issued Sep. 4, 2001, in U.S. Pat. No. 6,415,625, titled "AUXILIARY ACTIVE MOTOR VEHICLE HEATING AND AIR CONDITIONING SYSTEM" and issued Jul. 9, 2002, and in U.S. Pat. No. 6,477,856 titled "RECUPERATION IN SOLID-VAPOR SORPTION SYSTEM USING SORPTION ENERGY AND VAPOR MASS FLOW" and issued Nov. 12, 2002, the entire disclosure of each of which is incorporated by reference herein.

The systems and methods described herein provide further enhancement of the sorption rates for certain applications, such as applications with extreme size and/or weight requirements or sensitivity. For example, if a compound is the best available for the operating conditions, the needed energy storage capacity, and the available reaction rate, existing sorption systems to improve the sorber heat and mass transfer may nonetheless not have a high enough power density as required for the application.

The systems and methods described herein further enhance the absorption rate, desorption rate, or both. The enhancement can be applied to systems with single sorbers, multiple sorbers, systems in which all sorbers are operating in parallel, systems in which sorbers are operating in two or more time sequences of absorption, desorption, and temperature/pressure adjustment.

FIGS. 1A-6 show embodiments of systems and methods that may be used to improve the reaction rate and thereby power density by integrating a booster compressor. The sorption rates of coordinative complex compounds of these systems are largely driven by the "differential pressure," also referred to as the "approach pressure", and which is the actual gas or refrigerant pressure applied to the compound versus the equilibrium pressure at which no sorption would occur. With the knowledge of the equilibrium properties of the specific coordinative complex compound, the differential pressure can be converted into a differential temperature, also referred to as the "subcooling" of the compound or the "approach temperature." The selection of the specific complex compound may take into account the required operating temperature, which, in the case of cooling, sets the desired cooling and heat rejection temperature as well as the needed approach temperature or pressure to assure adequate reaction rates and thus resulting power densities.

The use of a compressor improves, for example increases, the differential pressure between the refrigerant pressure actually facing the compound and the equilibrium pressure. Such boost pressure improvements, or the amount of the increase in the pressure above an existing pressure in the sorber and/or gas lines, may range from less than 1 bar to 12 bar, from less than 1 bar to 25 bar, or in the single digit bar range. The increase in pressure above the existing pressure may be 0.25 bar, 0.5 bar, 1 bar, 2 bar, 3 bar, 4 bar, 5 bar, 6 bar, 7 bar, 8 bar, 9 bar, 10 bar, 11 bar, 12 bar, 13 bar, 14 bar, 15 bar, 16 bar, 17 bar, 18 bar, 19 bar, 20 bar, 21 bar, 22 bar, 23 bar, 24 bar, 25 bar, 26 bar, 27 bar, 28 bar, 29 bar, 30 bar, or more. The increase in pressure may be about any of these values. The increase in pressure above the existing pressure may be within certain ranges, for example from about 0.25 bar to about 15 bar, from about 0.5 bar to about 12 bar, from about 1 bar to about 12 bar, from about 1 bar to about 10 bar, from 1 bar to 25 bar, from about 2 bar to about 8 bar, or other ranges. Any of these pressure values or ranges may be used for absorbing or desorbing. The increase in pressure above the existing pressure within the system may be different depending on whether the sorber is absorbing or desorbing, as further described. During absorption, the refrigerant pressure coming from an evaporator or different complex compound sorber is increased to facilitate faster absorptions. The base pressure, prior to compression, could be already above the equilibrium pressure, could be right at equilibrium pressure or could be below the equilibrium pressure. Hence, the compressor may merely facilitate faster sorption rates, facilitate the sorption process, bring the pressure to a level that the sorption process can be operated or any combination thereof.

In desorption, similar principles apply. The compressor may be used to boost the pressure to the condenser or other receiving sorber, with the base pressure being already over equilibrium pressure, at equilibrium pressure, or below equilibrium pressure. The desorption boost pressure may range from 0.5 bar to 25 bar, or any other pressure values or ranges specified above and herein, depending on the application.

Having the option to operate compressor-assisted systems in any of these modes allows for the complex compound sorbers to be operated at temperatures that would otherwise not facilitate similar sorption rates. For example, in the case of desorption, the sorber does not have to be as hot as otherwise needed and may be operated at a reduced desorption temperature. During absorption, the sorber does not have to operate at a temperature as low as would be required to obtain the desired sorption rate. The particular sorber operating temperatures and compressor-enhanced operating pressures can be optimized and cooperatively controlled by a control system for the requirements of a particular application. In some applications, the operating characteristics may call for a larger compressor boost, and in other applications the sorber temperatures may handle most of the differential pressure requirements.

Further, keeping the desorption sorber temperature lower and or the absorption temperature higher reduces the energy flows and times required to switch sorbers from the desorbing mode to the absorbing mode, and vice versa. This will generally increase the thermal system functionality and overall thermal output.

Such compressor enhancement can be applied to systems in which sorbers are operating out of phase as well as systems in which sorbers operate in phase. The selection of sorber operating modes is application specific and is based on considerations such as energy efficiency, size, weight and system complexity with respect to plumbing, valving and controls.

Example particular embodiments of various systems and methods for sorption systems having a booster compressor that may be used to achieve these and other performance requirements will now be described in detail.

Figure 1A:
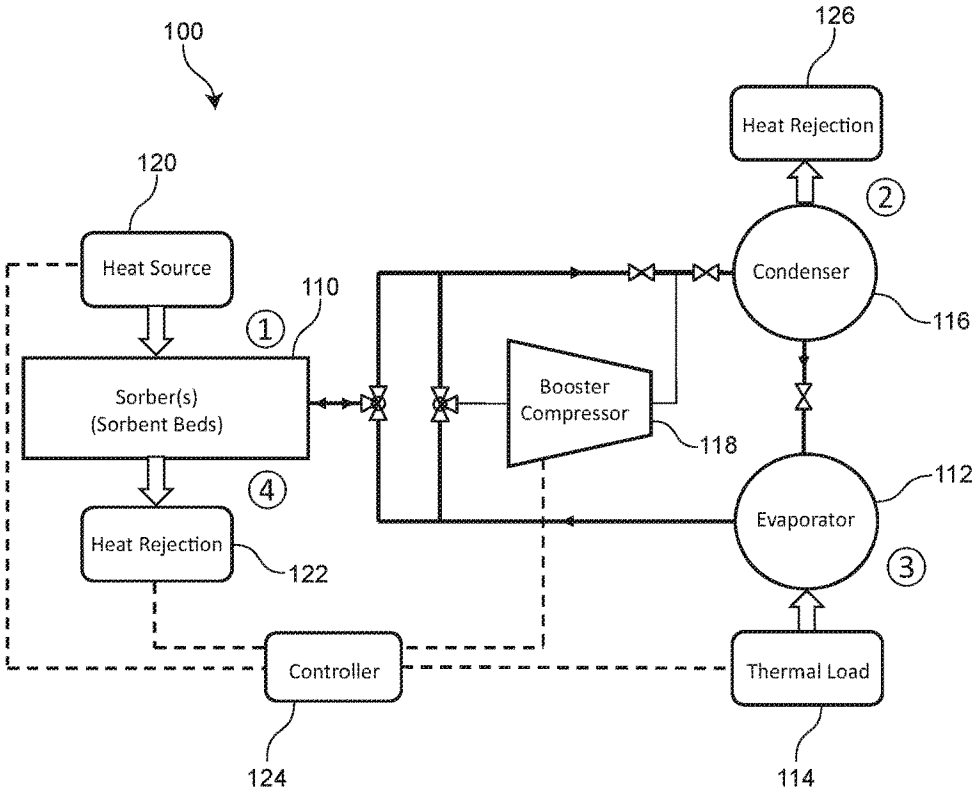
FIG. 1A is a schematic illustration of an embodiment of a compressor-assisted sorption system having a single sorber and is shown prior to activation of the compressor.

FIG. 1A is a schematic illustration of an embodiment of a compressor-assisted sorption system 100 having a single sorber or multiple parallel sorbers and shown prior to compressor assistance.

The system 100 includes a sorber 110, an evaporator 112, a condenser 116, and a compressor 118. The sorber 110, evaporator 112, condenser 116, and compressor 118 are in fluid communication with each other. A gas and/or liquid, such as a refrigerant, may flow between the various components through the conduits shown connecting the components. The sorber 110 may include a solid complex compound, also referred to as a "sorbent bed," configured to absorb a gas onto, and desorb a gas from, the compound. The solid complex compound may be an ammoniated complex compound having an absorbent comprising an alkali halide, an alkali-earth halide, or a transition metal halide. The absorbent may comprise $SrCl_2$, $CaCl_2$, $MnCl_2$, $MgCl_2$, LiCl, or $CoCl_2$. The gas may flow between the sorber 110 and the evaporator 112, condenser 116 and/or compressor 118. The gas may be ammonia in one embodiment.

The compressor 118 may be an oil-free compressor. The compressor 118 may be integrated with a lubricant management system. The compressor 118 may be electrically, hydraulically or pneumatically driven.

The system 100 may be configured to thermally condition, e.g. cool or heat, a thermal load 114. As shown, the evaporator 112 is in thermal communication, for example convective and/or conductive thermal communication, with the thermal load 114, to remove heat from and cool the thermal load 114. The condenser 116 is designed to reject heat at position 126, for example rejecting heat to ambient air, or to a phase change system, or to a closed (or open) heat transfer system. In some embodiments, the heat rejection position 126 may include an object or space intended to be heated by the system 100 such that the system 100 may be used to provide heating at the heat rejection position 126. In some embodiments, the heat rejected from the condenser 116 may be recycled within the system 100, such as to supplement a heat source 120 or other thermal system.

The system 100 includes the heat source 120 in thermal communication, for example convective and/or conductive thermal communication, with the sorber 110. The heat source 120 may be a thermal system configured to heat the sorber 110. The heat source 120 may be at a temperature above an ambient temperature. The heat source 120 may be at a temperature above an internal temperature of the sorber 110. In some embodiments, the heat source 120 provides heat to the sorber 110 to increase the temperature of the gas and/or complex compound beds within the sorber 110 and help drive the gas from the sorbent beds in one cycle of the system. The sorber 110 is in thermal communication with a heat rejection apparatus 122, such as a fan or ambient air or a phase change or heat transfer fluid system. In some embodiments, the heat rejection apparatus 122 may be an object or space intended to be heated by the system 100 such that the system 100 may be used to provide heating to other components adjacent to the heat rejection apparatus 122. In some embodiments, the heat rejected from the system 100, such as at position 126 or apparatus 122, may be re-used within the system 100. The heat rejected from the various heat rejection sources of the system 100 may be used for a variety of purposes, such as for other heating needs such as heating laser diodes, to supplement the heat source 120, other uses, or combinations thereof.

The system 100 includes a controller 124. The controller 124 may be an electronic controller, such as a processor with various control modules, a memory, etc., as further described herein, for example with respect to FIG. 5. As shown in FIG. 1A the controller 124 is in electronic communication, for example wired or wireless communication, with the heat source 120, the heat rejection apparatus 122, the compressor 118, and the thermal load 114. The controller 124 may be in communication with fewer or more than these components, for example with the sorber 110, the heat rejection position 126, the evaporator 112, the condenser 116, valves, fans or other portions of the system 100.

The controller 124 may be configured to cooperatively control operation of the compressor 118 and the heat source 120 to adjust, for example increase or decrease, a rate of absorption of the gas onto and/or desorption of the gas from the complex compound of the sorber 110. The controller 124 may receive feedback from the various systems or components to control the system 100 accordingly. The controller 124 may receive feedback from a temperature sensor attached to the thermal load 114 and/or the heat rejection apparatus 122. The data received by the controller 124 may be used to control the operation of the compressor 118 and the heat source 120 to allow the system to provide increased cooling capacity at a predetermined size or weight. In some embodiments, the controller 124 may also be in communication with and receive data from and/or control the condenser 116, the evaporator 122, and/or the heat rejection position 126.

The sorption system 100 produces thermal conditioning, e.g. refrigeration or cooling, through the sorption of the refrigerant by the sorbent media beds. A complex compound is one class of solid sorbent media and may provide advantages over other liquid and solid sorbents. The enabling principle for sorption refrigeration and chilling or chill storage is that zeotropic mixtures of pure substances exhibit a vapor pressure between that of the constituents. Thus the mixture vapor pressure is lower than the pressure of the more volatile component, often referred to as vapor pressure suppression. The most volatile substance may be the refrigerant. Ammonia-water mixtures are one useful example. Ammonia is the refrigerant, and water is the absorbent which provides the vapor pressure suppression.

Refrigeration or cooling is produced by allowing a lean sorbent in the sorber 110 to draw in refrigerant vapor from the evaporator 112. The evaporator 112 and the sorbent in the sorber 110 may be at essentially the same pressure, so evaporation occurs at a much lower temperature than the solution temperature. The more vapor pressure suppression, the larger the temperature difference possible between the evaporator 112 and the solution or sorber 110. As the solution becomes richer in refrigerant, it must be regenerated, i.e. refrigerant must be driven off. This may be accomplished by heating the sorbent of the sorber 110 to drive off refrigerant vapor, and letting the vapor condense, typically near ambient temperature. Lean sorbent is then cooled and allowed to again absorb refrigerant from the evaporator 112.

The same processes may be used for sorption refrigeration whether the sorbent is liquid or solid. The process may include the following: sorption of refrigerant from the evaporator 112, heating the sorbent of the sorber 110 to an elevated temperature, desorption of refrigerant to the condenser 116, and cooling the sorbent of the sorber 110 back to absorption temperature. These processes may be executed in a continuous manner for liquid-vapor sorption, with the liquid solution being cycled through the sorber 110 in the case of a single sorber 110 system, or in the case of a system with multiple sorbers by being pumped between the sorber 110 that is absorbing and another generator (desorber). Solid sorbent systems are periodic, with the sorber 110, or each sorber in a multiple-sorber system, undergoing these processes sequentially. An example of a multiple sorber system is further described herein, for example with respect to FIGS. 2A-3B.

FIG. 1B is a pressure-temperature data plot 130 showing an embodiment of a thermal cycle corresponding to use of the sorption system 100. For the plot 130, the compressor 118 is turned off or otherwise not yet assisting the thermal sorption cycle performed by the system 100. This is shown and described here for comparison with the system 100 after the compressor is turned on or is otherwise assisting the cycle, as described below with respect to FIGS. 1C and 1D.

As shown in the plot 130 in FIG. 1B, the vapor pressure of the pure refrigerant and the complex compound are plotted versus temperature. Ammonia is used in this embodiment as the refrigerant. State point numbers 1, 2, 3 and 4 on the pressure-temperature plot 130 in FIG. 1B correspond to the approximate locations of the state point numbers 1, 2, 3 and 4 in the schematic of the system 100 in FIG. 1A. The state point numbers are used for references for ease of tracing and describing the cycle.

From state point 4 to state point 1, the sorber 110 is heated until the pressure in the sorber 110 is greater than the pressure in the condenser 116, shown as state point 2. Consequently, ammonia vapor is driven off the complex compound and flows to the condenser 116, and becomes a liquid. In some embodiments, the sorbent may be heated to about 180° C. (Celsius) to drive ammonia to a 40° C. condenser 116. Liquid refrigerant then flows from the condenser through an expansion valve to the evaporator 112 which is at much lower pressure. In some embodiments, the evaporator 112 may be at −40° C. and about 0.7 bar at state point 3. The temperature of the sorber 110 and/or the pressure of the evaporator 112 may be maintained so that refrigerant vapor is then drawn back to the sorber 110. Heat is rejected from the sorber 110 at state point 4. In some embodiments, the pressure of the evaporator 112 may be maintained by a second sorbent bed of a second sorber, as described for example with respect to FIGS. 2A-3B, which is cooled to a low enough temperature for the sorbent pressure to be below evaporator pressure. As shown in FIG. 1A, refrigerant vapor is drawn from the evaporator 112 back into the sorbent of the sorber 110.

Use of the compressor may decrease the absorption and/or desorption times, by enhancing the sorption rates. When an absorption process is complete, the bed is heated for regeneration (desorption). When the desorption process is complete, the bed is cooled for absorption. In some embodiments, two sorbent beds from separate sorbers may operate out of phase to produce continuous refrigeration or cooling. Unequal absorption and desorption periods can be used to avoid time periods with no suction on the evaporator 112.

The desorption reaction in the sorber 110 is endothermic, so energy is required to drive the desorption as well as heat the sorbent bed(s). Heat is the energy source which drives the cycle. Heat from many sources may be used, such as gas combustion, waste heat, electrical resistance heat, or solar. Integration of heat into the cycle is accomplished with pumped loops, heat pipes, thermosyphons, cartridge heaters, or other appropriate means. Maintenance of low evaporator 112 temperature and pressure during absorption requires that the sorber(s) be cooled to maintain the required "approach pressure".

The absorption process in the sorber 110 is exothermic so heat removal is required for most or the entire absorption period. The heat rejection apparatus 122 may be achieved by cooling using forced air flow, pumped loops, phase-change refrigerant, or other means depending on the application.

The refrigerant in the system 100 without the compressor 118 assistance may flow between the sorber 110, the condenser 116 and the evaporator 112, as indicated by the thicker lines and arrows connecting the components in FIG. 1A. Thus, no gases may be flowing between the various lines and the compressor 118, for sake of this description, as shown by the thinner lines connecting the compressor 118. Once the compressor is turned on, gases may be flowing through these compressor lines, as discussed for example with respect to FIG. 1C.

The controller 124 may electronically communicate with the various components of the system 100 to perform the various methods discussed herein. The controller 124 may include a processor that receives data signals related to feedback from, and/or provide data signals intended to control components of, the system 100, such as from/to the thermal load 114, the heat source 120, the heat rejection apparatus 122, and the compressor 118. The controller 124 may also communicate with the other components in such manner, such as the sorber 110, the evaporator 112, the condenser 116, and/or the heat rejection position 126.

The controller 124 may cooperatively control the heat source 120 and the compressor 118 to cooperatively, e.g. intelligently, control respectively the temperature and pressure within the system 100 such that the thermal cycle rate as discussed herein is enhanced, for example increased, and the thermal load is optimally thermally conditioned, for example cooled. The controller 124 may control the heat source 120 and the compressor 118 in response to analysis of data related to various operating parameters of the system 100. Such parameters may include the temperature(s) and pressure(s) within the system. For example, the controller 124 may control the heat source 120 and the compressor 118 in response to analysis of data related to the current temperature and pressure within the sorber 110, and/or the current temperature of the thermal load 114. The controller 124 may be configured to operate the compressor 118 based on control parameters comprising i) a pre-determined desired temperature of the thermal load 114 and/or ii) a pre-determined desired capacity of the sorption system 100. The control parameters may be based on a required cooling of the thermal load 114 and a measured ambient temperature, humidity and/or current altitude of the device. Ambient temperature may refer to a temperature of the environment surrounding the thermal load 114 and/or the system 100.

Changes in the temperature and pressure within the system 100 may trigger the controller to adjust the various operating parameters. For instance, the controller 124 may receive data signals indicating a temperature threshold of the thermal load 114 is satisfied, and the controller 124 may consequently control the various parameters mentioned. In some embodiments, the controller may be directly communicating with a laser control system, such that firing of a laser system may trigger the controller 124 to perform such cooperative control of the system 100. Further details of the controller 124 and its use with the system 100 and other systems described herein are provided herein, for example with respect to FIGS. 5-6.

Figure 1D:
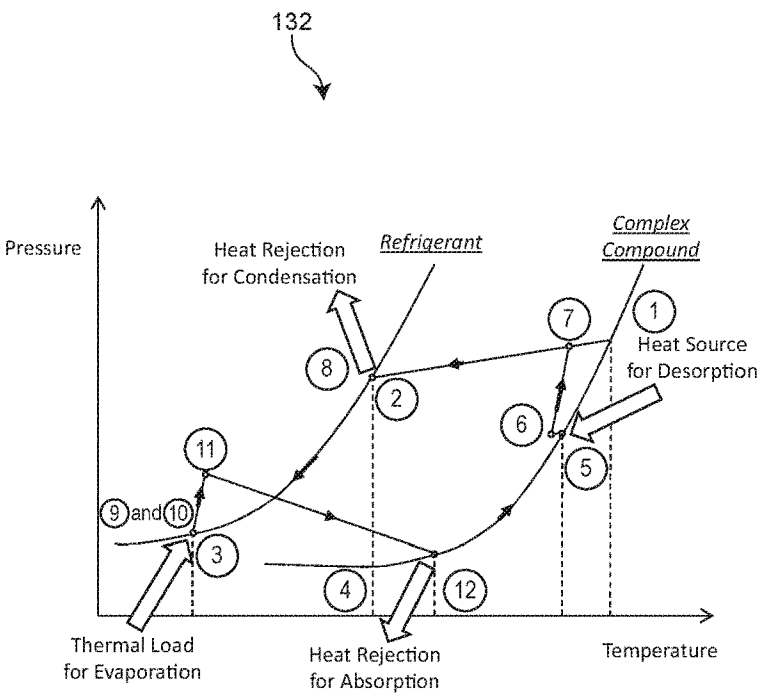
FIG. 1D is a pressure-temperature data plot showing an embodiment of a thermal cycle corresponding to use of the sorption system of FIG. 1C.
Figure 1C:
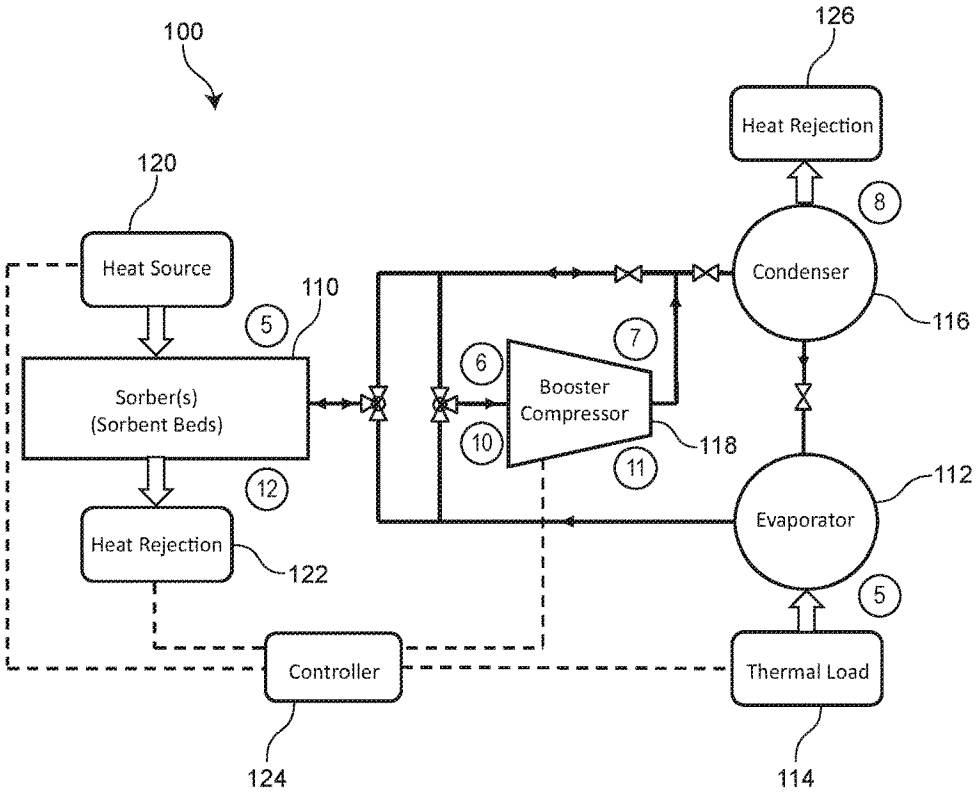
FIG. 1C is a schematic illustration of the sorption system of FIG. 1A using wherein the compressor is activated.

FIG. 1C is a schematic illustration of the sorption system 100 including assistance from the compressor 118. The controller 124 may electronically communicate with the compressor 118 to provide such assistance to the system 100, which may be triggered by an event, based on analysis of the various parameters discussed herein, based on timing, etc. The compressor 118 has been turned on, or is otherwise operating at an operating speed sufficient to provide assistance to the system 100 by adjusting the pressure within the sorber 110 via the various lines connecting the compressor 118 to the sorber 110.

The compressor 118 and the heat source 120 may be controlled to cooperatively control a rate of absorption of the gas onto, and a rate of desorption of the gas from, the solid complex compound. The pressure of the gas may be adjusted between i) the evaporator and the sorber, ii) between the condenser and the sorber, or iii) both between the evaporator and the sorber and between the condenser and the sorber. The compressor 118 may flow compressed gas to the condenser 116 and/or the sorber 110. The differential pressure within the sorber 110 may be increased due to the compressor 118 to accelerate the rates of absorption and desorption of the gas.

The thermal cycle rate may be enhanced due to the increase in the pressure of the gas flowing out of the sorber 110 during desorption to reduce a desorbing temperature required for desorption at a desired desorption rate. The controller 124 may be configured to operate the compressor 118 to enhance the rate of absorption by increasing the pressure of the gas above and beyond an existing pressure, for example from about 0.5 bar to about 15 bar higher pressure. The "existing pressure" may be a pressure within the sorber and/or gas lines that would exist without or prior to compressor assistance. For an absorption the resulting pressure increase or "boost" range may be 0.5 to 15 bar in one embodiment, or between 1 to 6 bar in another embodiment. In some embodiments, for an absorption period the increase in pressure above the existing pressure may be between about 1 bar and about 12 bar, between about 1 bar and about 8, 10, 12 or 15 bar, between about 1.5 bar and about 10 bar, between about 2 bar and about 8 bar, between about 2.5 bar and about 10 bar, between about 3 bar and about 8 bar, or other amounts. The controller 124 may be configured to operate the compressor 118 to enhance the rate of desorption by increasing the pressure of the gas, for example from about 1 bar to about 25 bar higher than the existing pressure. For a desorption, pressure increase or "boost" ranges may be 2 to 25 bar, or 3 to 15 bar. In some embodiments, for a desorption the increase in pressure above the existing pressure may be between about 1 bar and about 24 bar, between about 1 bar and about 18, 19, 20, 21, 22 or 23 bar, between about 1.5 bar and about 22 bar, between about 2 bar and about 20 bar, between about 2.5 bar and about 18 bar, between about 3 bar and about 16 bar, or other amounts. These are example pressure increase values, and others may be implemented depending on the particular application.

Further, the pressure assistance from the compressor 118 may change during the thermal process. For example, after initiating the process, and as the complex compound heats up or cools down, the assistance from the compressor may be reduced. Thus, a desorption assistance may start at 15 or 20 bar when the compound is not at full design temperature yet, and then be reduced as the compound is heated up to only 10 bar or less. Similar adjustments may be done for the absorption cycle.

FIG. 1D is a pressure-temperature data plot 132 showing an embodiment of a thermal cycle corresponding to use of the compressor 118 to assist the sorption system 100. The state points 5-12 in FIG. 1D correspond respectively to state points 5-12 of FIG. 1C. State points 1-4 from FIG. 1B are also shown in FIG. 1D for ease of reference. As shown in FIG. 1D, with compressor assistance, desorption occurs at a lower temperature, as indicated by the lower temperature of state points 5-7 (with compressor assistance) as compared to state point 1 (without compressor assistance). Thus, the required temperature/heat to be supplied by the heat source 120 for desorption is lower with compressor assistance, as compared to not having the compressor assistance. The higher pressures in the system 100 with compressor assistance are indicated by the higher pressure at state point 11 (with compressor assistance) as compared to state point 3 (without compressor assistance). The resulting heat rejection occurs at a higher pressure as shown by state point 12 (with compressor assistance) as compared to state point 4 (without compressor assistance).

Thus, the use of the compressor 118 can be used to achieve various objectives, or a combination of objectives. For example, the controller can be configured to activate the compressor 118 to be used to decrease the desorption temperature, as mentioned. As further example, the compressor 118 can be used to increase the absorption temperature. For instance, as shown in FIG. 1D, the temperature at state point 12 (with compressor assistance) is greater than the temperature at state point 4 (without compressor assistance). As further example, the sorption reaction rates may be increased by increasing the differential pressures. For instance, as shown in FIG. 1D, the difference between the pressures at state points 11 and 12 (with compressor assistance) is greater than the difference between the pressures at state points 3 and 4 (without compressor assistance). In some embodiments, combinations of these objectives may be achieved with the corresponding described use of the system 100 and cooperative control of the heat source 120 and the compressor 118.

Various particular values for the pressures and temperatures at the state points 5-12 may be implemented depending on the application. Some example values are provided here, which may be used for a laser system as the thermal load 114. In some embodiments, at state point 5, the pressure may be about 166 psia (pounds per square inch absolute, i.e., relative to a vacuum), and the temperature may be about 90°

C. (Celsius). At state point 6, the pressure may be about 163 psia, and the temperature may be about 88° C. At state point 7, the pressure may be about 240 psia, and the temperature may be about 100° C. At state point 8, the pressure may be about 230 psia, and the temperature may be about 41° C. At state point 9, the pressure may be about 90 psia, and the temperature may be about 10° C. At state point 10, the pressure may be about 90 psia, and the temperature may be about 10° C. At state point 11, the pressure may be about 145 psia, and the temperature may be about 25° C. At state point 12, the pressure may be about 60 psia, and the temperature may be about 65° C. The particular values may be within +/−5%, within +/−10%, or within +/−20% of the aforementioned values. This is just one example cycle and other cycles with different values may be used.

Figure 2A:
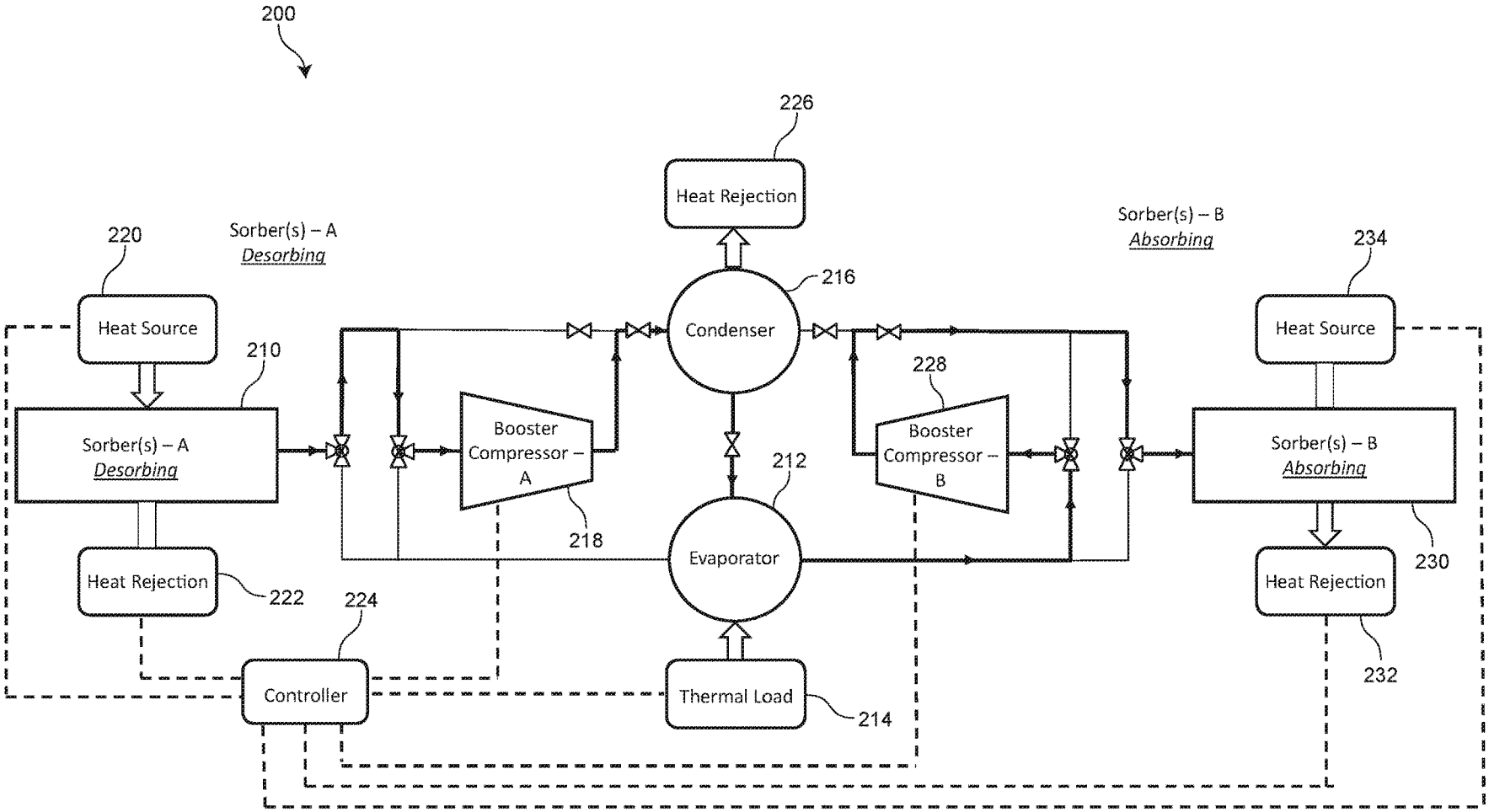
FIG. 2A is a schematic illustration of an embodiment of a compressor-assisted sorption system using multiple sorbers operated out of phase with each other, with a first sorber (Sorber(s)-A) desorbing and a second sorber (Sorber(s)-B) absorbing, and using compressor assistance from multiple compressors.

FIG. 2A is a schematic illustration of an embodiment of a compressor-assisted sorption system 200 that includes two compressors. The system 200 may have the same or similar features and/or functions as the system 100, except as otherwise described. The system 200 as shown is using first and second sorbers 210, 230 operated out of phase with each other. The first sorber 210 is shown desorbing and the second sorber 230 is shown absorbing using compressor assistance from first and second compressors 218, 228 respectively. More than two sorbers may be implemented. For example, there may be a sorber bank "A" on the left side of the figure as oriented having multiple sorbers, in which all sorbers of the bank "A" desorb together, then absorb together, etc. Similarly, there may be a sorber bank "B" on the right side of the figure as oriented having multiple sorbers, in which all sorbers of the bank "B" absorb together, then desorb together, etc. The two banks may each include two, three, four, five, ten, twenty, fifty, one hundred, or more sorbers. The banks may be operated out of phase or in phase with each other. In some embodiments, there may be more than two banks of sorbers. The temperatures and pressures of the sorber or sorbers of each bank may operate according to the thermal cycles described herein, for example the cycles shown in the plots 130 and 132 in FIGS. 1B and 1D respectively. Further, there may be more than or fewer than two compressors. There may be one, three, four, five, ten, twenty, fifty, or more compressors.

As shown, the system 200 includes the sorbers 210, 230, an evaporator 212, a thermal load 214, a condenser 216, the compressors 218, 228, heat sources 220, 234, heat rejections 222, 232, a heat rejection 226, and a controller 224, which may have the same or similar features and/or functions as, respectively, the sorber 110, the evaporator 112, the thermal load 114, the condenser 116, the compressor 118, the heat source 120, the heat rejection positions 122, the heat rejection position 126, and the controller 124, except as otherwise described herein.

As shown in FIG. 2A, the two sorbers 210, 230, each having a sorbent bed, may be integrated into the system 200 for refrigeration, cooling, etc. The sorber 210, the compressor 218, the evaporator 212 and the condenser 216 may be in fluid communication with each other. Similarly, the sorber 230, the compressor 228, the evaporator 212 and the condenser 216 may be in fluid communication with each other. In some embodiments, the sorber 210, the compressor 218, the evaporator 212, the condenser 216, and the sorber 230 may be in fluid communication with each other.

In some embodiments, the portion of the system 200 comprising the condenser 216, an expansion valve, an evaporator 212 may be the same or similar to that portion of a vapor compression refrigeration system. Each sorber 210, 230 may be fitted with a pair of check valves (non-return valves), which may be similar to a cylinder on a compressor. The check valves may direct vapor exiting the sorbers 210, 230 to the condenser 216, and only allow inflow from the evaporator 212. Thus, flow of refrigerant vapor to and from the sorber beds of the sorbers 210, 230 may follow passively from heating and cooling of the sorbents in the sorbers 210, 230 by the respective heat sources 220, 234.

In FIG. 2A, the lines with gas flow and the direction of flow are indicated by the relatively thicker lines connecting the components and the arrows thereon. Further, the arrows at the sorbers 210, 234 and the evaporator 212 and condenser 216 indicate the direction of heat transfer. Thus heat is being transferred from the heat source 220 to the desorbing sorber 210, from the absorbing sorber 230 to the heat rejection 232, from the thermal load 214 to the evaporator, and from the condenser 216 to the heat rejection 226.

Figure 2B:
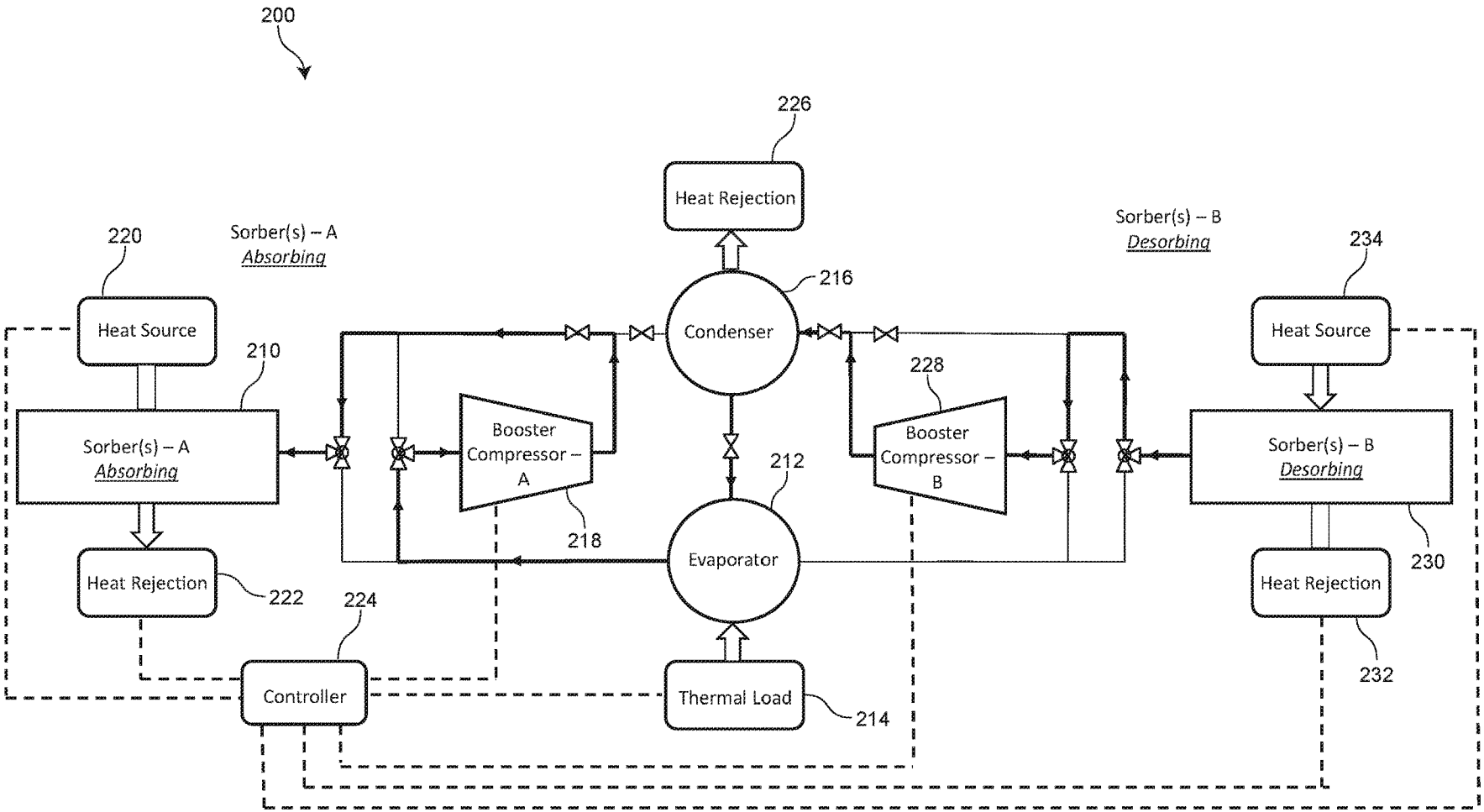
FIG. 2B is a schematic illustration of the sorption system of FIG. 2A, having the first sorber (Sorber(s)-A) absorbing and the second sorber (Sorber(s)-B) desorbing.

FIG. 2B is a schematic illustration of the sorption system 200 showing the first sorber 210 absorbing and the second sorber 230 desorbing. As shown, heat is being transferred from the heat source 234 to the desorbing sorber 230, from the absorbing sorber 210 to the heat rejection 222, from the thermal load 214 to the evaporator 212, and from the condenser 216 to the heat rejection position 226. The system 200 may be used as shown in FIG. 2B after the heat transfer process described with respect to FIG. 2A. This may be repeated, with the heat transfer process then returning to the process as described with respect to FIG. 2A, etc.

Figure 2C:
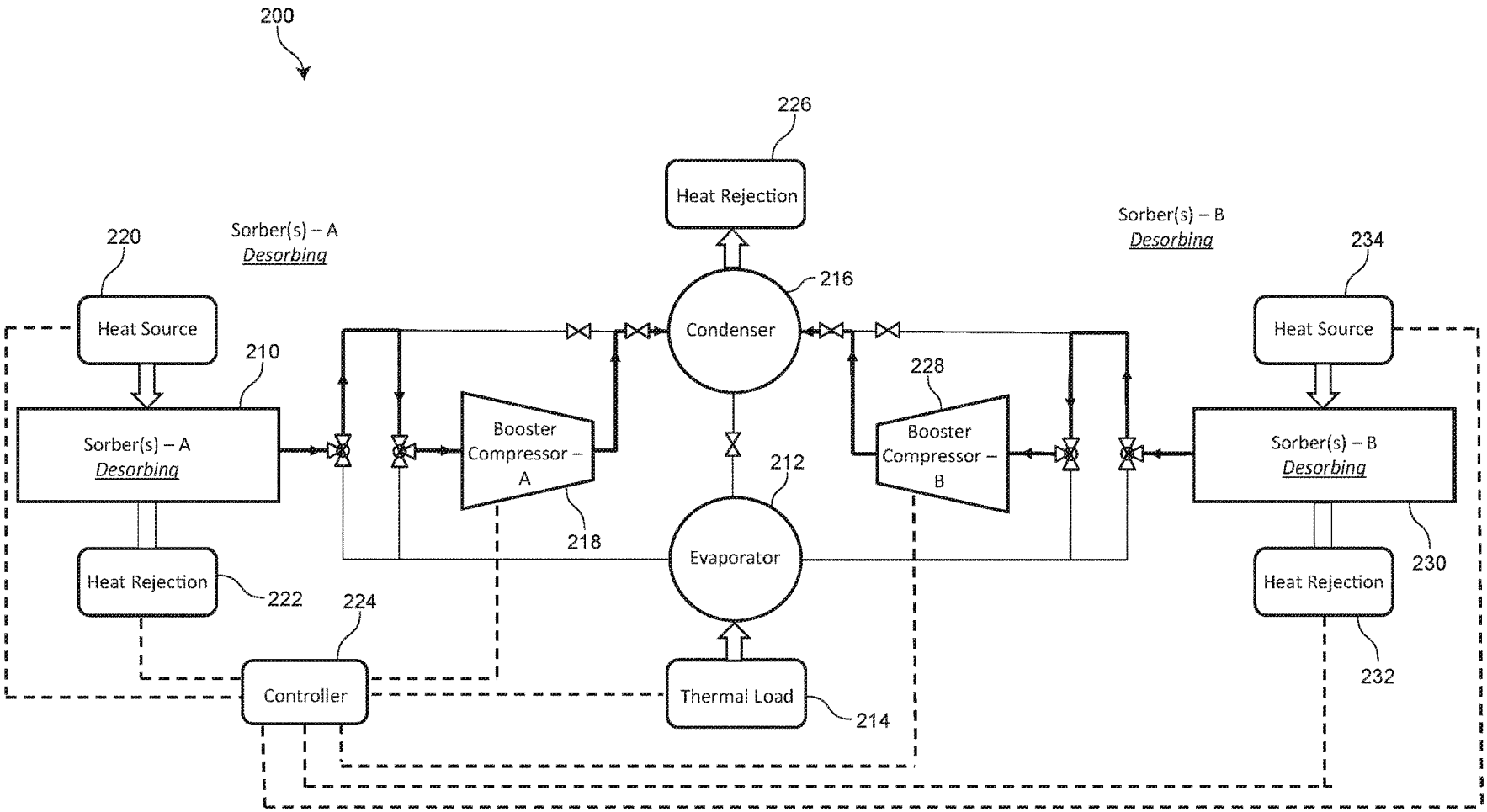
FIG. 2C is a schematic illustration of an embodiment of a compressor-assisted sorption system using multiple sorbers operated in phase with each other with a time delay, with first and second sorbers shown desorbing, and using compressor assistance from multiple compressors.

FIG. 2C is a schematic illustration of the sorption system 200 using the sorbers operated in phase with each other with a time delay, using compressor assistance from the compressors 218, 228. Heat is being transferred from the heat source 220 to the desorbing sorber 210, from the heat source 234 to the desorbing sorber 230, from the thermal load 214 to the evaporator 212, and from the condenser 216 to the heat rejection position 226. The first and second sorbers 210, 230 are both shown desorbing with a time delay. This can occur in various situations, including in multi-sorber systems with out of phase operation and unequal absorption and desorption time durations. For example, in an out-of-phase complex compound system the absorption time period may be half of the desorption time. In such a system, the desorption processes for both sorber 210 and sorber 230 may overlap.

Figure 2D:
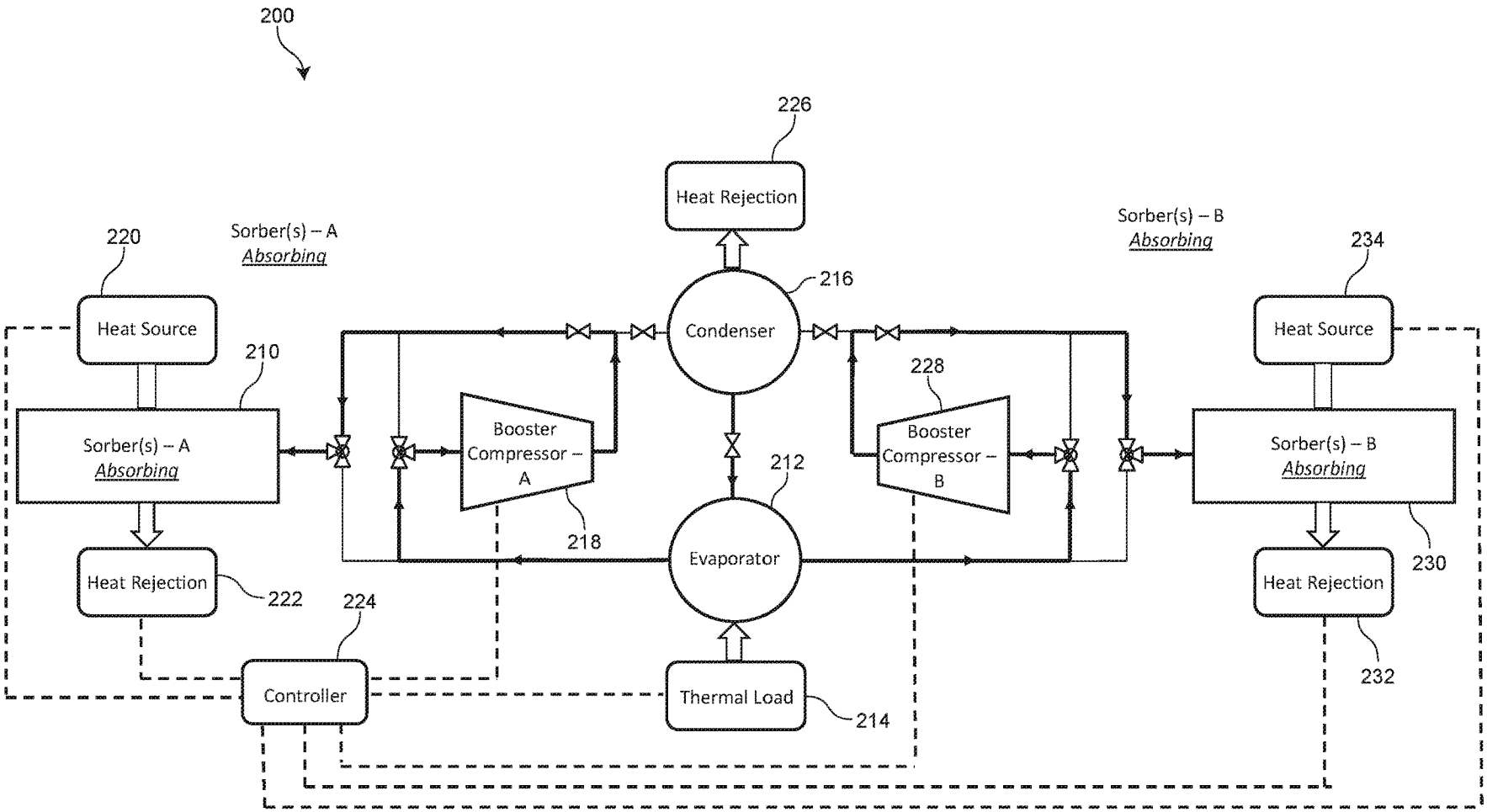
FIG. 2D is a schematic illustration of the sorption system of FIG. 2C, with the first and second sorbers shown absorbing.

FIG. 2D is a schematic illustration of the sorption system 200 similar to that of FIG. 2C but with the first and second sorbers both shown absorbing. The sorbers may be operated in phase with each other with a time delay, using compressor assistance from the compressors 218, 228. Heat is being transferred from the absorbing sorber 210 to the heat rejection apparatus 222, from the absorbing sorber 230 to the heat rejection apparatus 232, from the thermal load 214 to the evaporator, and from the condenser 216 to the heat rejection position 226. The first and second sorbers 210, 230 are both shown absorbing with a time delay. This can occur in various situations, including in multi-sorber systems with out of phase operation and unequal absorption and desorption time durations. For example, in an out-of-phase complex compound system, the absorption time period may be half of the desorption time. In such a system, the absorption processes for both sorber 210 and sorber 230 may overlap.

Figure 3A:
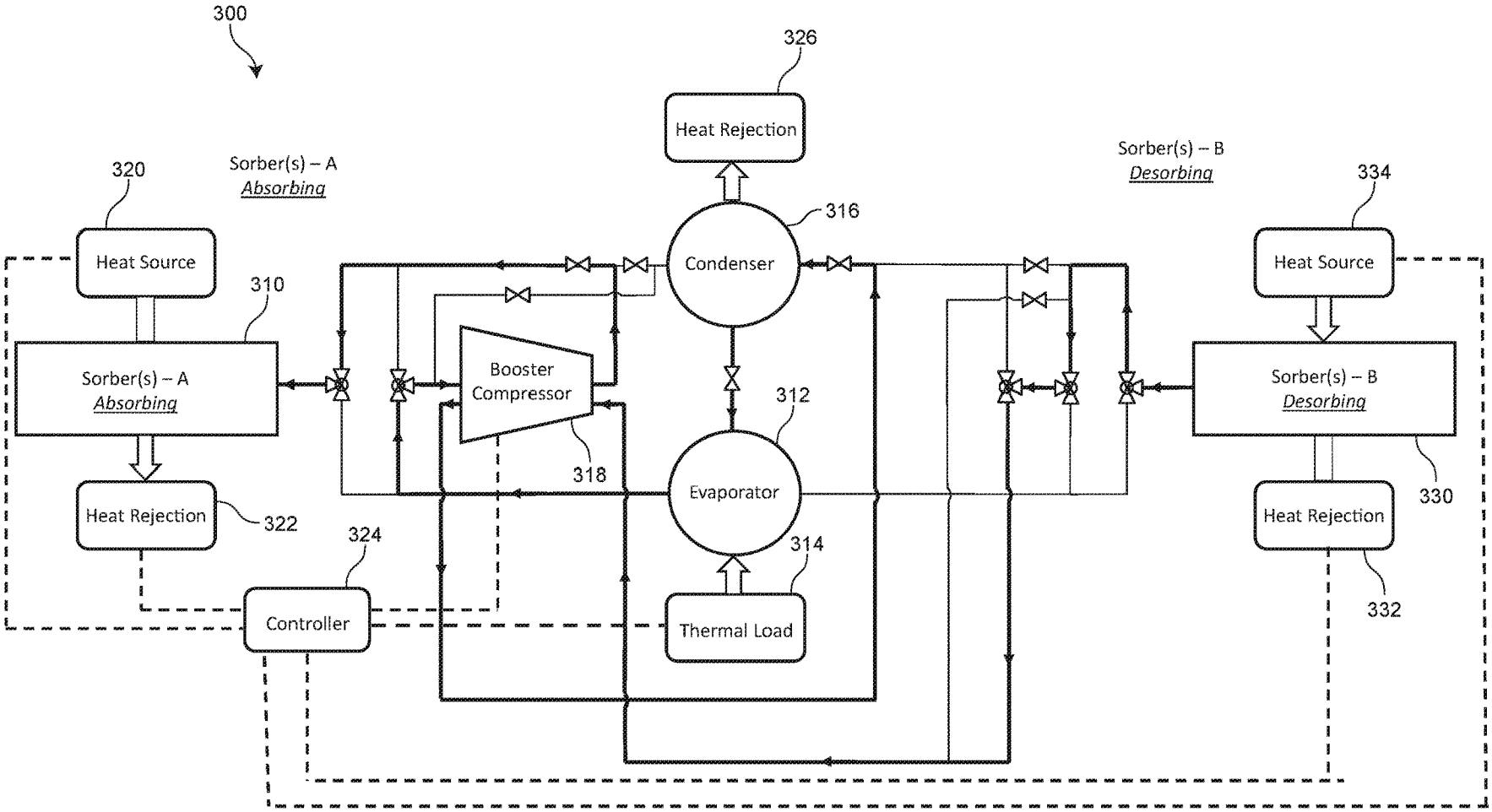
FIG. 3A is a schematic illustration of an embodiment of a compressor-assisted sorption system using multiple sorbers operated out of phase with each other, with a first sorber (Sorber(s)-A) absorbing and a second sorber (Sorber(s)-B) desorbing, and using compressor assistance from a single compressor.

FIG. 3A is a schematic illustration of an embodiment of a compressor-assisted sorption system 300 with a single compressor and two sorbers. The system 300 may have the same or similar features and/or functions as the system 200, except as otherwise described. The system 300 as shown is using first and second sorbers 310, 330 operated out of phase with each other, with the first sorber 310 absorbing and the second sorber 330 desorbing, and using compressor assistance from a single compressor 318. The compressor 318 may be used for compression and expansion for both of the sorbers 310, 330, which each may be sorber banks as described with respect to FIG. 2A. The first sorber 310 may be part of a sorber bank "A" and the second sorber 330 may be part of a second sorber bank "B," as described. The temperatures and pressures of the sorber or sorbers of each bank may operate according to the thermal cycles described herein, for example the cycles shown in the plots 130 and 132 in FIGS. 1B and 1D respectively.

As shown, the system 300 includes the sorbers 310, 330, an evaporator 312, a thermal load 314, a condenser 316, the compressor 318, the heat sources 320, 334, heat rejections apparatus 322, 332, a heat rejection position 326, and a controller 324, which may have the same or similar features and/or functions as the same components described above. The sorber 310, the compressor 318, the evaporator 312 and the condenser 316 may be in fluid communication with each other. Similarly, the sorber 330, the compressor 318, the evaporator 312 and the condenser 316 may be in fluid communication with each other. In some embodiments, the sorber 310, the compressor 318, the evaporator 312, the condenser 316, and the sorber 330 may be in fluid communication with each other.

The controller 324 may control the compressor 318 and the heat sources 320, 334 to control the pressures and temperatures cooperatively for the system 300. The controller 324 may control the system 300 to achieve the various performance objectives described herein, for example as described with respect to FIG. 1D. For the system 300 as shown in FIG. 3A, in some embodiments, the high-pressure refrigerant of the second sorber 330 expands in the expander section of the booster compressor 318, which will drive the compressor section of the booster compressor 318 and will result in an increase in the refrigerant pressure of the first sorber 310. In some embodiments, the refrigerant of the first sorber 310 will not mix with the refrigerant of the second sorber 330 in the compressor 318.

Figure 3B:
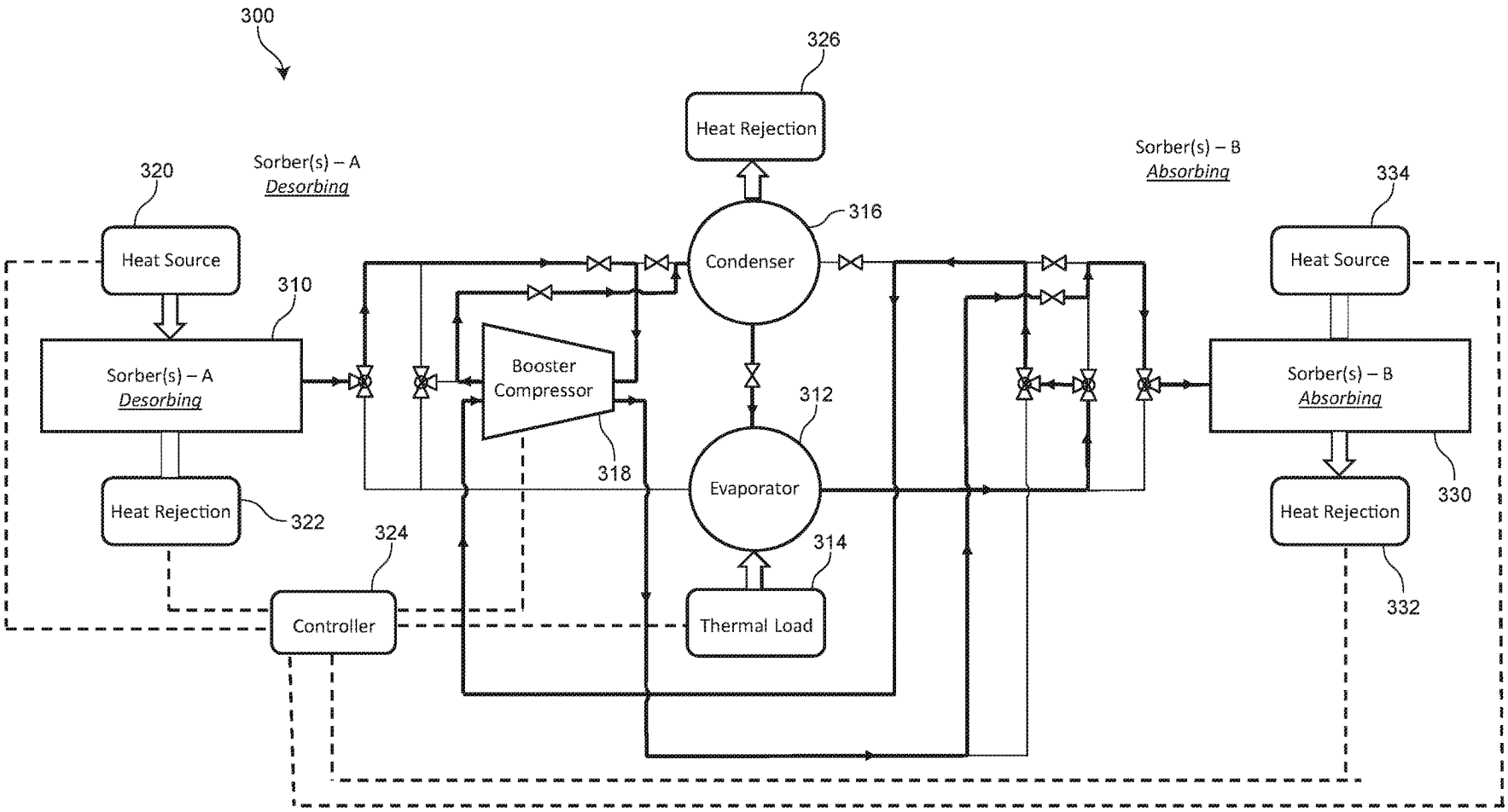
FIG. 3B is a schematic illustration of the sorption system of FIG. 3A, with the first sorber (Sorber(s)-A) desorbing and the second sorber (Sorber(s)-B) absorbing.

As shown in FIG. 3A, heat is being transferred from the heat source 334 to the desorbing sorber 330, from the absorbing sorber 310 to the heat rejection apparatus 322, from the thermal load 314 to the evaporator 312, and from the condenser 316 to the heat rejection position 326. The system 300 may be used as shown in FIG. 3B after the heat transfer process described with respect to FIG. 3A. This may be repeated, with the heat transfer process then returning to the process as described with respect to FIG. 3A, etc.

FIG. 3B is a schematic illustration of the sorption system 300, with the first sorber 310 desorbing and the second sorber 330 absorbing. The temperatures and pressures of the system 300 may be controlled with the controller 324 to enhance the thermal cycle rate. As shown in FIG. 3B, heat is being transferred from the heat source 320 to the desorbing sorber 310, from the absorbing sorber 330 to the heat rejection apparatus 332, from the thermal load 314 to the evaporator 312, and from the condenser 316 to the heat rejection 326. The system 300 may be used as shown in FIG. 3B after the heat transfer process described with respect to FIG. 3A. This may be repeated, with the heat transfer process then returning to the process as described with respect to FIG. 3A, etc.

For the system 300 as shown in FIG. 3B, in some embodiments, the high-pressure refrigerant of the first sorber 310 expands in the expander section of the booster compressor 318, which will drive the compressor section of the booster compressor 318 and will result in an increase in the refrigerant pressure of the second sorber 330. In some embodiments, the refrigerant of the second sorber 330 will not mix with the refrigerant of the first sorber 310 in the compressor 318.

Figure 4:
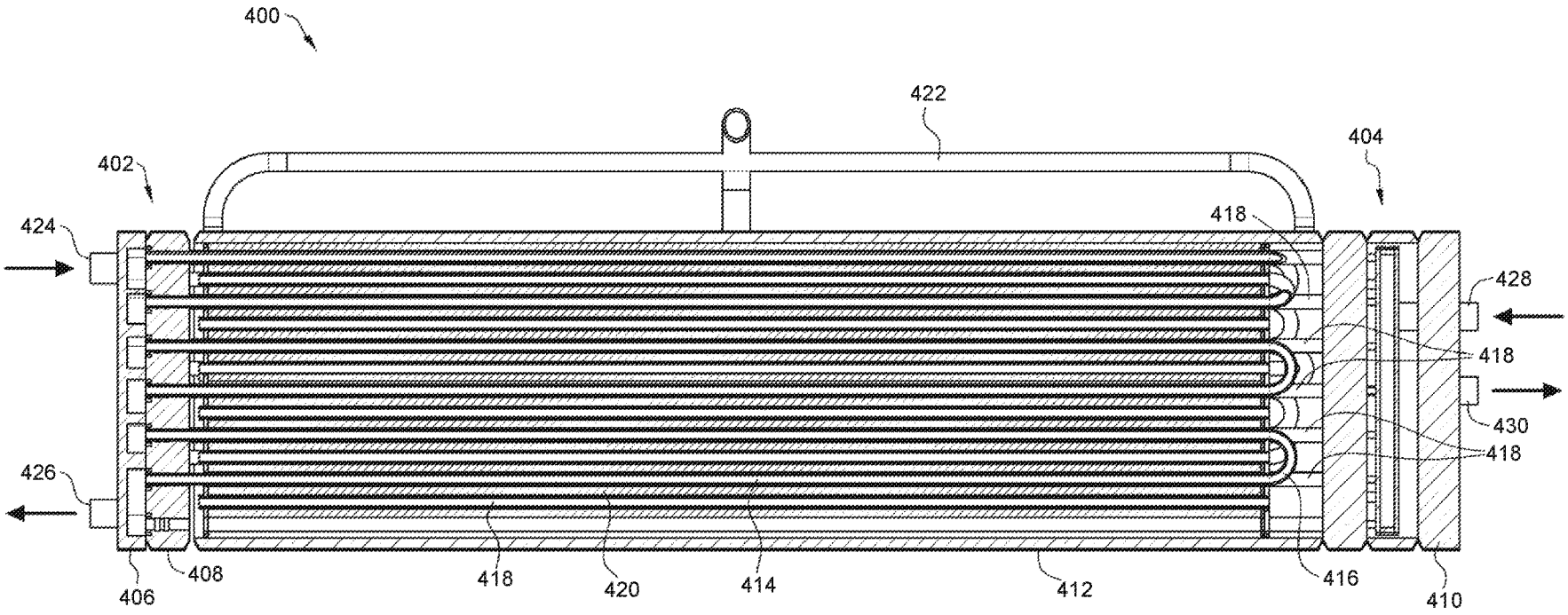
FIG. 4 is a cross-section view of an embodiment of a sorber that may be used in one embodiment of the sorption systems of FIGS. 1A-3B.

FIG. 4 is a longitudinal cross-section view of an embodiment of a sorber 400 that may be used with the sorption systems described herein, such as the systems 100, 200, or 300 of FIGS. 1A-3B. The sorber 400 is one example sorber, and different embodiments and configurations thereof may be used in the sorption systems. For example, other embodiments of sorbers that may be used are shown and described, for example, in U.S. Pat. No. 9,822,999 titled "SYSTEMS, DEVICES AND METHODS FOR GAS DISTRIBUTION IN A SORBER" and issued Nov. 21, 2017, in U.S. Patent Publication No. 2018/0252447, titled "BURST MODE COOLING SYSTEM" and published on Sep. 6, 2018, and in U.S. Patent Publication No. 2018/0252453, titled "INTELLIGENT COOLING SYSTEM" and published on Sep. 6, 2018, the entire disclosure of each of which is hereby incorporated by reference herein.

As shown in FIG. 4, the sorber 400 includes a lower end 402 and an upper end 404 that is opposite the lower end 402. The ends 402 and 404 facilitate moving thermal transfer media through a set of heat transfer tubes 414 that traverse the interior of the sorber 400. The lower end 402 includes a hot thermal media inlet 424 and an outlet 426 that communicate with a first circuit of the heat transfer tubes 414. The upper end 404 includes the cold thermal media inlet 428 and an outlet 430 that communicate with a second circuit of the heat transfer tubes 414.

The sorber 400 has an outer shell 412 that is an elongated cylindrical layer that surrounds and encapsulates a complex compound sorbent 420 disposed within the interior of the sorber 400. The lower end 402 of the sorber 400 includes a hot fluid box 406 and a feed box 408. The hot fluid box 406 contains a fluid, such as ethylene glycol/water, that is distributed through the heat transfer tubes 414 which run adjacent the complex compound sorbent and are used to heat the sorbent to release the ammonia gas. The upper end 404 of the sorber 400 includes a cold fluid box 410. The cold fluid box 410 may be a cooling fluid bonnet. The cold fluid box 410 provides cool fluid, such as ammonia from a reservoir, or ethylene glycol/water to a second circuit of heat transfer tubes 414 within the sorber 400 to cool the sorber 400 between thermal cycles. By flowing a heat transfer medium through the heat transfer tubes 414, which are adjacent the complex compound material, heat may be transferred to and from the sorbent material to cause the absorption and desorption processes. The heat transfer tubes 414 may have bends 416, which may be "U" shaped bends.

The sorber 400 includes a sorber gas pipe 422 for flowing the sorber gas to and from the sorber 400. The sorber gas flows from the pipe 422 and into the sorber 400 in various locations. The sorber gas may flow from the pipe 422 and into a set of tubes 418, which may be porous gas distribution tubes, for example as described in in U.S. Patent Publication No. 2018/0252447, titled "BURST MODE COOLING SYSTEM" and published on Sep. 6, 2018, the entire disclosure of which is hereby incorporated by reference herein. The gas may flow into and out of the sorber 400 in response to changes in the temperature and pressure within the sorber 400, which may be controlled cooperatively by the controllers described herein.

Figure 5:
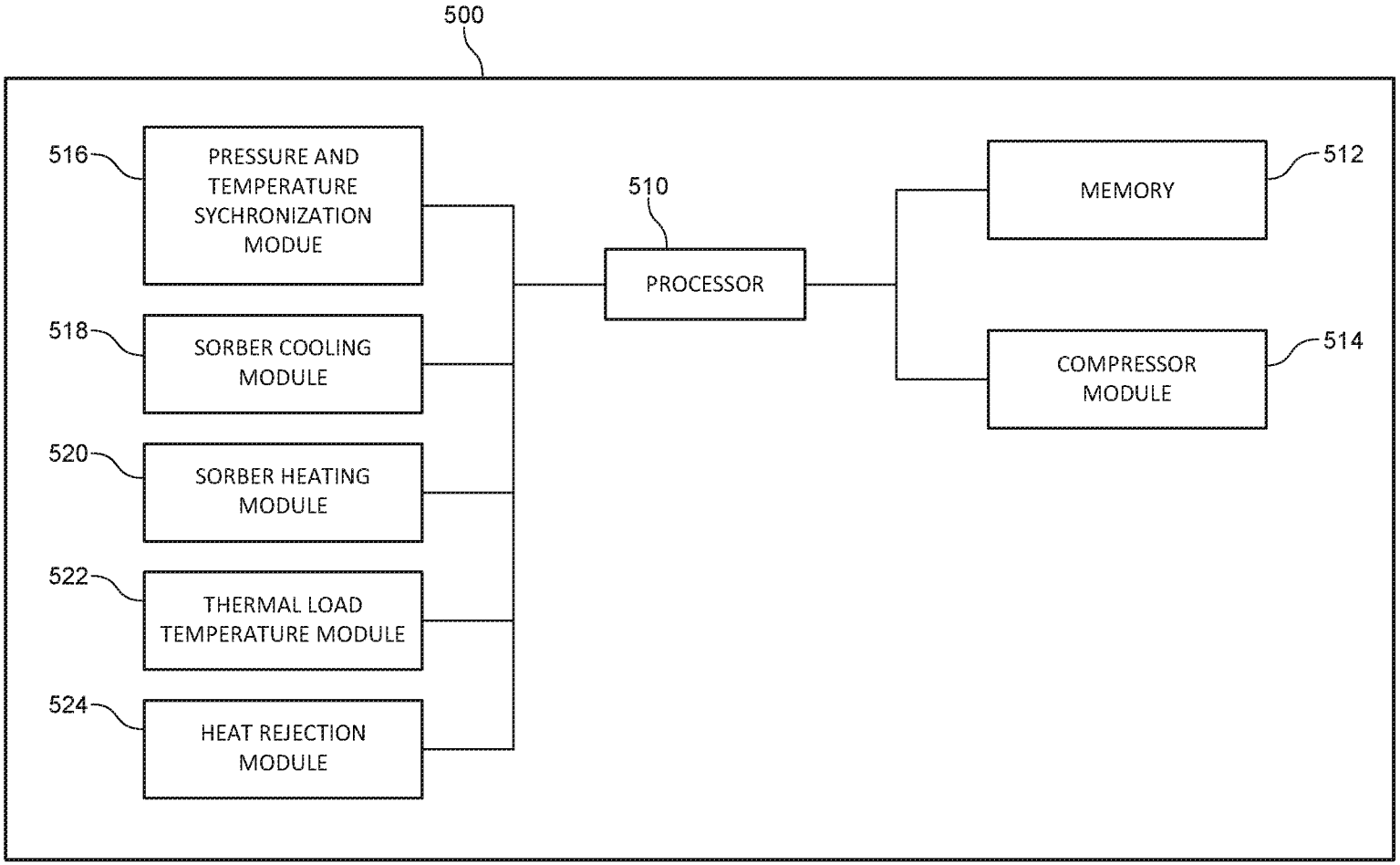
FIG. 5 is a block diagram of an embodiment of a controller that may be used with the sorption systems of FIGS. 1A-3B to cooperatively control components of a compressor-assisted sorption system.

FIG. 5 is a block diagram of an embodiment of a controller 500 that may be used with the sorption systems described herein, such as the systems 100, 200, or 300 of FIGS. 1A-3B. The controller 500 may cooperatively control the compressor(s) and heating/cooling source(s) to enhance the absorption and desorption rates. The controller 500 may be used as the controllers 124, 224 or 324 in embodiments of the invention.

The controller 500 includes a processor 510 in electronic communication with a memory 512, a compressor module 514, and various other modules. As shown, each module contains instructions stored therein that may be executed by the processor 510. The modules include a pressure and temperature synchronization module 516, a sorber cooling module 518, a sorber heating module 520, a thermal load temperature module 522, and a heat rejection module 524. The electronic communications may be wired or wireless. The various components may be co-located or remotely located from each other, for example the controller 500 may communicate with a cloud network for updates to the various modules, etc.

The compressor module 514 may be used to control the pressure of the sorber gases within the system by controlling the activity of one or more compressors, such as the compressors 118, 218, 228, 318 or 328. The compressor module 514 may be commanded by the processor 510 based on analysis of the current pressure(s) and/or temperature(s) of the system, which may be provided by other modules such as the synchronization module 516. The compressor module may control the activation, speed, torque or any other controllable aspect of a compressor within the system. The compressor module 514 may also be used to control the various valves in any of the systems described herein, such as the systems 100, 200, or 300.

The synchronization module 516 may be used to cooperatively control the pressures and temperatures of the sorbers, such as the sorbers 110, 210, 234, 310, 334, or 400, in order to enhance the cycle rate and/or achieve other objectives with the various systems. The synchronization module 516 may be used to analyze current and/or desired temperature(s) within the system in order to control the flow of the heating and cooling fluids through one or more sorbers, such as described with respect to the sorber 400 of FIG. 4. The synchronization module 516 may be used to analyze current and/or desired pressure(s) within the system and output data to be analyzed by the processor 510 using the compressor module 514 to control the pressure of the gases as described. The synchronization module 516 may be used to control the various valves in any of the systems described herein, such as the systems 100, 200, or 300.

The sorber cooling module 518 may be used to cool one or more sorber(s) to cause the sorber(s) to absorb the gas onto the compound therein. The sorber heating module 520 may be used to heat the sorber to cause the sorber to desorb the gas from the compound therein. The thermal load temperature module 522 may be used to detect the temperature of the thermal load, such as the thermal loads 114, 214, 314, which may be used to control the temperatures or pressures of the sorbers. The heat rejection module 524 may be used to detect the ambient temperature, such as the heat rejection positions/apparatuses 126, 226, 326, which may be used to control the heat rejection fan(s) or pump(s) speeds. The modules 518, 520, 522, 524 may be used to control the various valves in any of the systems described herein, such as the systems 100, 200, or 300.

In some embodiments, the pressure and temperature synchronization module 516 contains instructions that the processor 510 executes to cooperatively control the temperature (s) and pressures(s) of one or more sorbers or sorber banks in a sorption system. The processor 510 using the synchronization module 516 may analyze data from temperatures or pressure sensors within the system that are sampling the temperatures and pressures, as well as related to a current temperature of the thermal load. The load temperature module 522 contains instructions that the processor 510 executes to determine a current temperature or activity of the thermal load, such as a temperature or firing of a laser system. The processor 510 using the synchronization module 516 may generate a command to adjust the temperature and/or pressure of the sorber(s), for example by controlling the sorber thermal (heating/cooling) source(s) and compressor(s). The sorber cooling module 518 may contain instructions that the processor 510 executes, based on analysis using the synchronization module 516, to cool the sorber(s) to reduce the temperature therein. The sorber heating module 520 may contain instructions that the processor 510 executes, based on analysis using the synchronization module 516, to heat the sorber(s) to increase the temperature therein. The compressor module 514 may contain instructions that the processor 510 executes, based on analysis using the temperature synchronization module 516, to command the compressor to generate higher or lower pressure within the sorber(s). This is one example of how the controller 500 and the various modules may be used to control the sorption systems. Other methods may be performed using the controller 500, such as the methods described herein with respect to FIG. 6.

Figure 6:
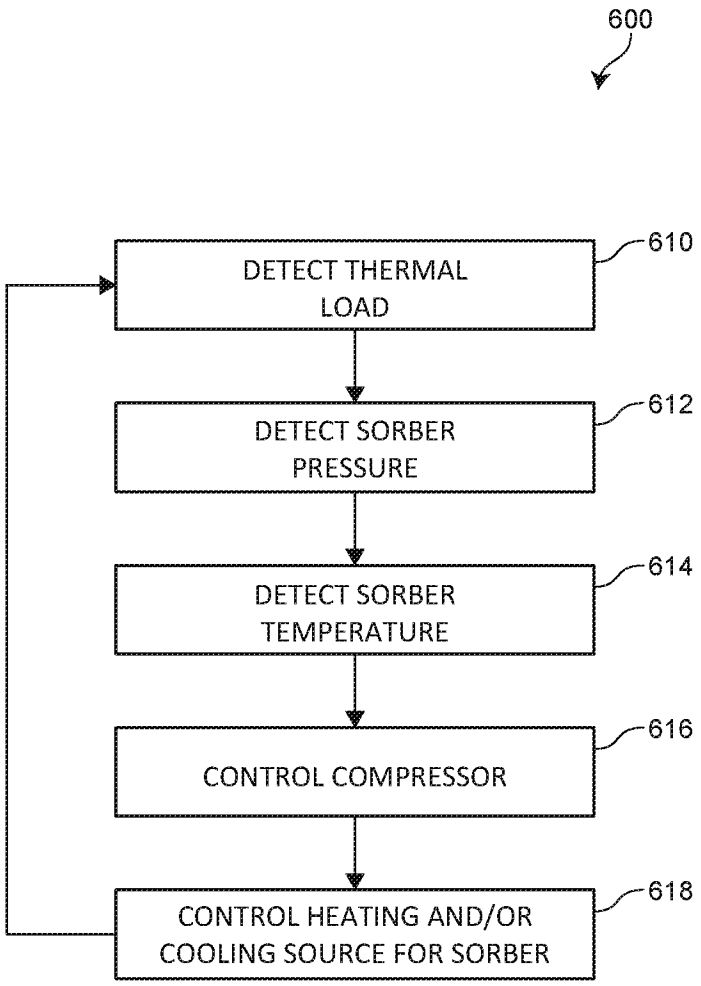
FIG. 6 is a flow chart showing an embodiment of a method for cooperatively controlling a compressor and heating/cooling source of a sorption system that may be used with the sorption systems of FIGS. 1A-3B.

FIG. 6 is a flow chart showing an embodiment of a method 600 for cooperatively controlling a compressor and heating/cooling source of a sorption system. The method 600 may be used with the sorption systems described herein, such as the systems 100, 200, or 300 of FIGS. 1A-3B. The method 600 may use the sorber 400 and/or the controller 500 shown and described with respect to FIGS. 4 and 5.

As shown in FIG. 6, the method 600 begins with step 610 where a thermal load is detected. A laser system firing and/or temperature increase may be detected. A thermal or other sensor may detect such activities or attributes of the thermal load. The thermal load may be the thermal load 114, 214 or 314. The controller 124, 224, 324, or 500 may receive data related to detection of the thermal load, for example using the processor 510 and the thermal load temperature module 522. A threshold temperature and/or activity indicator (e.g. firing of the laser) may be satisfied in step 610 in order to trigger the controller to respond accordingly. The detection in step 610 may be continuous or performed periodically such that the temperature or activity are constantly or periodically monitored.

The method 600 then moves to step 612 where a sorber pressure is detected. In some embodiments, steps 610 and 612 are performed simultaneously. In step 612, the pressure in the sorbers 110, 210, 230, 310, 330 or 400 may be detected. Pressure sensors within the sorbers may generate data related to the pressure within the sorbers. The pressure data may be communicated to the controller, such as the controller 124, 224, 324, or 500. The controller may receive data related to the pressure, for example using the processor 510 and the synchronization module 516. A threshold pressure may be satisfied in step 612 in order to trigger the controller to respond accordingly. The detection in step 612 may be continuous or performed periodically such that the pressure is constantly or periodically monitored. The pressures in multiple sorbers or banks may be detected in step 612.

The method 600 then moves to step 614 where a sorber temperature is detected. In some embodiments, steps 612 and 614 are performed simultaneously. In some embodiments, steps 610, 612 and 614 are performed simultaneously. In step 614, the temperature in the sorbers 110, 210, 230, 310, 330 or 400 may be detected. Temperature sensors within the sorbers may generate data related to the temperature within the sorbers. Sorber temperature may be obtained from temperature sensors within the sorbers heating/cooling fluid loop(s). The temperature data may be communicated to the controller, such as the controller 124, 224, 324, or 500. The controller may receive data related to the temperature, for example using the processor 510 and the synchronization module 516. A threshold temperature may be satisfied in step 614 in order to trigger the controller to respond accordingly. The detection in step 64 may be continuous or performed periodically such that the temperature is constantly or periodically monitored. The temperatures in multiple sorbers or banks may be detected in step 612.

The method 600 then moves to step 616 where a compressor is controlled. The compressor may be the compressor 118, 218, 228 or 318. The compressor may be controlled based on the data related to the temperature and/or pressure of the sorbers, the temperature of the thermal load, other parameters, or combinations thereof. The compressor may be controlled to achieve the various objectives, for example the objectives discussed herein with respect to FIG. 1D. The compressor operation may be adjusted to increase or decrease the pressure in one or more sorbers or banks. The processor 510 may executes instructions from the compressor module 514 to control the compressor, for example as discussed herein with respect to FIG. 5. Step 616 may be performed based on execution by the processor 510 of the instructions in the synchronization module 516. Step 616 may be performed in response to the detected temperatures and pressure in steps 610, 612 and/or 614. Steps 610, 612 and/or 614 may be performed simultaneously and the results analyzed together in order to perform step 616. Pressure sensors may detect the pressures at various locations in or near the compressor, and the related pressure data may be communicated to the controller in step 616 for control of the compressor.

The method 600 then moves to step 618 wherein the thermal source for the one or more sorbers is controlled. The thermal source may be controlled to control the heating and/or cooling of the sorber(s). The heat sources 120, 220, 234, 320 or 334 may be controlled to increase or decrease heating supplied to the sorber(s). The heat rejections 122, 222, 232, 322 or 332 may be controlled to increase or decrease cooling supplied to the sorber(s). Instructions in the sorber heating or cooling modules 520, 518 may be executed by the processor 510. Steps 616 and 618 may preformed simultaneously such that the compressor and the sorber thermal sources are controlled simultaneously. Data related to the current temperature of the thermal load, and/or data related to the current temperature and/or pressure of the sorber(s), may be analyzed during step 618 to accordingly adjust the control of the compressor and the sorber thermal sources.

The control of the temperature and pressure within the sorber as described may affect the thermal conditioning applied to a thermal load. For example, an evaporator within the sorption system may adjust, e.g. increase or decrease, the cooling provided to a laser system. Other thermal conditioning may be applied and adjusted using the method 600. After step 618, the method 600 may then return to step 610 and repeat as described.

The various illustrative logical blocks, modules, and circuits described in connection with the implementations disclosed herein may be implemented or performed with a general purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general purpose processor may be a microprocessor, but in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration.

The steps of a method or process described in connection with the implementations disclosed herein may be embodied directly in hardware, in a software module executed by a processor, or in a combination of the two. A software module may reside in RAM memory, flash memory, ROM memory, EPROM memory, EEPROM memory, registers, hard disk, a removable disk, a CD-ROM, or any other form of non-transitory storage medium known in the art. An exemplary computer-readable storage medium is coupled to the processor such the processor can read information from, and write information to, the computer-readable storage medium. In the alternative, the storage medium may be integral to the processor. The processor and the storage medium may reside in an ASIC. The ASIC may reside in a user terminal, camera, or other device. In the alternative, the processor and the storage medium may reside as discrete components in a user terminal, camera, or other device.

All references cited herein are incorporated herein by reference in their entirety. To the extent publications and patents or patent applications incorporated by reference contradict the disclosure contained in the specification, the specification is intended to supersede and/or take precedence over any such contradictory material.

The term "comprising" as used herein is synonymous with "including," "containing," or "characterized by," and is inclusive or open-ended and does not exclude additional, unrecited elements or method steps.

The previous description of the disclosed implementations is provided to enable any person skilled in the art to make or use the present invention. Various modifications to these implementations will be readily apparent to those skilled in the art, and the generic principles defined herein may be applied to other implementations without departing from the spirit or scope of the invention. Thus, the present invention is not intended to be limited to the implementations shown herein but is to be accorded the widest scope consistent with the principles and novel features disclosed herein.

While the above description has pointed out novel features of the invention as applied to various embodiments, the skilled person will understand that various omissions, substitutions, and changes in the form and details of the device or process illustrated may be made without departing from the scope of the invention.

What is claimed is:

1. A thermal sorption system comprising:

a sorber configured to at least one of absorb a sorber gas on solid complex compounds or desorb the sorber gas from the solid complex compounds;

a thermal system configured to be in thermal communication with the solid complex compounds;

an evaporator configured to be in thermal communication with a thermal load;

a condenser;

a compressor in fluid communication with the sorber, the evaporator, and the condenser, wherein the compressor is configured to compress the sorber gas to provide a pressure of the sorber gas within the sorber;

one or more sensors configured to sample at least one of a temperature within the thermal sorption system or a pressure within the thermal sorption system; and a control system configured to:

receive data indicative of the at least one of the temperature sampled by the one or more sensors or the pressure sampled by the one or more sensors, and in response to receiving the indicative data, operate the compressor to at least one of increase or decrease the pressure of the sorber gas within the sorber to control at least one of a rate of the absorption of the sorber gas onto the solid complex compound or a rate of the desorption of the sorber gas from the solid complex compound, wherein the thermal sorption system is configured to transfer thermal energy from the thermal load at a rate dependent on the at least one of the rate of absorption or the rate of desorption.

2. The thermal sorption system of claim 1, wherein the control system is further configured to operate the compressor to adjust the pressure of the sorber gas between i) the evaporator and the sorber, ii) between the condenser and the sorber, or iii) both between the evaporator and the sorber and between the condenser and the sorber.

3. The thermal sorption system of claim 1, wherein the control system is further configured to operate the compressor to increase a differential pressure of the sorber to accelerate the rates of absorption and desorption of the sorber gas.

4. The thermal sorption system of claim 1, wherein the control system is further configured to operate the compressor to decrease the pressure of the sorber gas in the sorber during desorption to reduce a desorbing temperature required for desorption at a desired desorption rate.

5. The thermal sorption system of claim 1, wherein the control system is further configured to operate the compressor to enhance the rate of absorption by increasing the pressure of the sorber gas between 0.5 bar and 15 bar above an existing pressure.

6. The thermal sorption system of claim 1, wherein the control system is further configured to operate the compressor to enhance the rate of desorption by increasing the pressure of the sorber gas between 1 bar and 25 bar above an existing pressure.

7. The thermal sorption system of claim 1, wherein the sorber gas is ammonia.

8. The thermal sorption system of claim 1, wherein the compressor is an oil-free compressor.

9. The thermal sorption system of claim 1, wherein the compressor is integrated with a lubricant management system.

10. The thermal sorption system of claim 1, wherein the compressor is electrically, hydraulically or pneumatically driven.

11. The thermal sorption system of claim 1, wherein the compressor comprises a compressor section and an expander section.

12. The thermal sorption system of claim 1, wherein the solid complex compound is an ammoniated complex compound having an absorbent comprising an alkali halide, an alkali-earth halide, or a transition metal halide.

13. The thermal sorption system of claim 12, wherein the absorbent comprises SrCl, CaCl, MnCh, MgCl, LiCl, or $CoCl_2$.

14. The thermal sorption system of claim 1, wherein the control system is further configured to operate the compressor based on control parameters comprising i) a desired temperature of the thermal load, ii) a desired capacity of the thermal sorption system, or iii) operating conditions including at least one of ambient temperature, humidity, or altitude.

15. The thermal sorption system of claim 14, wherein the control parameters are based on a required cooling of the thermal load and the ambient temperature.

16. The thermal sorption system of claim 14, wherein the thermal load comprises a laser system.

17. The thermal sorption system of claim 1, wherein the sorber is a first sorber, and further comprising:

a second sorber configured to absorb the sorber gas onto, and desorb the sorber gas from, a solid complex compound of the second sorber, wherein the second sorber is in fluid communication with the evaporator, the condenser and the compressor; and a second thermal system in thermal communication with the second sorber and configured to adjust a temperature of the second sorber, wherein the control system is in electronic communication with the second thermal system and is further configured to operate the compressor, the thermal system, and the second thermal system cooperatively to control a rate of absorption of the sorber gas onto, and a rate of desorption of the sorber gas from, the solid complex compounds of the first and second sorbers.

18. The thermal sorption system of claim 1, wherein the sorber is a first sorber and the compressor is a first compressor, and further comprising:

a second compressor in fluid communication with the evaporator and the condenser;

a second sorber configured to absorb the sorber gas onto, and desorb the sorber gas from, the solid complex compound of the second sorber, wherein the second sorber is in fluid communication with the evaporator, the condenser and the second compressor; and a second thermal system in thermal communication with the second sorber and configured to adjust a temperature of the second sorber, wherein the control system is in electronic communication with the second thermal system and is further configured to operate the second compressor and the second thermal system cooperatively to control a rate of absorption of the sorber gas onto, and a rate of desorption of the sorber gas from, the solid complex compound of the second sorber.

19. A thermal sorption system comprising:

a plurality of sorbers each having a respective solid complex compound and configured to absorb a gas onto, and desorb the gas from, the respective solid complex compound;

an evaporator in fluid communication with the plurality of sorbers and configured to be in thermal communication with a thermal load;

a condenser in fluid communication with the plurality of sorbers and the evaporator;

one or more compressors in fluid communication with the evaporator, the condenser, and one or more respective sorbers of the plurality of sorbers, wherein the one or more compressors are configured to compress the gas to provide a pressure of the gas in a respective sorber of the one or more respective sorbers;

a plurality of thermal systems each configured to be in thermal communication with at least one sorber of the plurality of sorbers and configured to adjust a temperature of the at least one sorber;

one or more sensors configured to sample at least one of a temperature within the thermal sorption system or a pressure within the thermal sorption system; and a control system configured to:

receive data indicative of the at least one of the temperature sampled by the one or more sensors or the pressure sampled by the one or more sensors, and in response to receiving the indicative data, operate the one or more compressors to at least one of increase or decrease the pressure of the gas in the respective sorber to control at least one of a rate of the absorption of the gas onto the respective solid complex compound of the respective sorber or a rate of the desorption of the gas from the respective solid complex compound of the respective sorber, wherein thermal sorption system is configured to transfer the thermal energy from the thermal load at a rate dependent on the at least one of the rate of absorption of the gas onto the solid complex compound of the respective sorber or the rate of desorption of the gas from the solid complex compound of the respective sorber.

20. The thermal sorption system of claim 19, wherein the control system is further configured to operate the one or more compressors to adjust the pressure of the gas between i) the evaporator and the plurality of sorbers, ii) between the condenser and the plurality of sorbers, or iii) both between the evaporator and the plurality of sorbers and between the condenser and the plurality of sorbers.

21. The thermal sorption system of claim 19, wherein the control system is further configured to operate the one or more compressors to increase a respective differential pressure of the respective sorber to accelerate the rates of absorption and desorption of the gas.

22. The thermal sorption system of claim 19, wherein the control system is further configured to operate the one or more compressors to decrease the pressure of the gas in the plurality of sorbers during desorption to reduce a desorbing temperature required for desorption at a desired desorption rate.

23. The thermal sorption system of claim 19, wherein the control system is further configured to operate the one or more compressors to enhance the rate of absorption by increasing the pressure of the gas between 0.5 bar and 15 bar above an existing pressure.

24. The thermal sorption system of claim 19, wherein the control system is further configured to operate the one or more compressors to enhance the rate of desorption by increasing the pressure of the gas between 1 bar and 25 bar above an existing pressure.

25. The thermal sorption system of claim 19, wherein the respective solid complex compound comprises an ammoniated complex compound having an absorbent comprising an alkali halide, an alkali-earth halide, or a transition metal halide.

26. The thermal sorption system of claim 25, wherein the absorbent comprises SrCl, CaCl, MnCh, MnCl, LiCl, or $CoCl_2$.

27. The thermal sorption system of claim 19, wherein the thermal load comprises a laser system.

28. A method of operating a thermal sorption system, comprising:

compressing, using a compressor, a sorber gas to provide a pressure of the sorber gas within a sorber, wherein the sorber is configured to at least one of absorb a sorber gas on solid complex compounds or desorb the sorber gas from the solid complex compounds, wherein the solid complex compounds are in thermal communication a first thermal system, wherein the compressor is in fluid communication with the sorber, a condenser, and an evaporator, and wherein the evaporator is in thermal communication with a thermal load;

sampling, using one or more sensors, at least one of a temperature within the thermal sorption system or a pressure within the thermal sorption system;

and receiving, by a control system, data indicative of the at least one of the temperature sampled by the one or more sensors or the pressure sampled by the one or more sensors; and operating, by the control system and in response to receiving the indicative data, the compressor to at least one of increase or decrease the pressure of the sorber gas within the sorber to control at least one of a rate of the absorption of the sorber gas onto the solid complex compound or a rate of the desorption of the sorber gas from the solid complex compound, wherein the thermal sorption system is configured to transfer thermal energy from the thermal load at a rate dependent on the at least one of the rate of absorption or the rate of desorption.

29. The method of claim 28, further comprising controlling the compressor to adjust the pressure of the sorber gas between i) the evaporator and the sorber, ii) between the condenser and the sorber, or iii) both between the evaporator and the sorber and between the condenser and the sorber.

30. The method of claim 28, further comprising controlling the compressor to increase a differential pressure of the sorber to accelerate rates of absorption and desorption of the sorber gas in the sorber.

31. The method of claim 28, further comprising controlling the compressor to decrease the pressure of the sorber gas in the sorber during desorption to reduce a desorbing temperature required for desorption at a desired desorption rate.

32. The method of claim 28, wherein the thermal load comprises a laser system.

* * * * *